US012116753B2

(12) United States Patent
Onodera et al.

(10) Patent No.: US 12,116,753 B2
(45) Date of Patent: Oct. 15, 2024

(54) WORK MACHINE AND INFORMATION PROCESSING APPARATUS

(71) Applicant: SUMITOMO HEAVY INDUSTRIES, LTD., Tokyo (JP)

(72) Inventors: Masaru Onodera, Kanagawa (JP); Takumi Itoh, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 444 days.

(21) Appl. No.: 17/412,475

(22) Filed: Aug. 26, 2021

(65) Prior Publication Data

US 2022/0002969 A1 Jan. 6, 2022

Related U.S. Application Data

(63) Continuation of application No. PCT/JP2020/008170, filed on Feb. 27, 2020.

(30) Foreign Application Priority Data

Feb. 28, 2019 (JP) ..... 2019-036481

(51) Int. Cl.
*E02F 9/20* (2006.01)
*E02F 3/32* (2006.01)
*E02F 9/26* (2006.01)

(52) U.S. Cl.
CPC ..... *E02F 9/2025* (2013.01); *E02F 9/2075* (2013.01); *E02F 9/262* (2013.01); *E02F 3/32* (2013.01)

(58) Field of Classification Search
CPC ..... E02F 9/2025; E02F 9/2075; E02F 9/262
USPC ..... 701/50
See application file for complete search history.

(56) References Cited

U.S. PATENT DOCUMENTS

| | | | | |
|---|---|---|---|---|
| 7,756,736 | B2 | 7/2010 | Nakayama et al. | |
| 10,538,897 | B2 | 1/2020 | Uetake et al. | |
| 2007/0073457 | A1* | 3/2007 | Lee | E02F 9/26 701/50 |
| 2007/0094055 | A1* | 4/2007 | Nakayama | E02F 9/2054 705/5 |
| 2007/0250834 | A1* | 10/2007 | Shibata | G06F 9/52 718/100 |
| 2009/0038282 | A1* | 2/2009 | Avalle | A01D 51/002 56/10.8 |

(Continued)

FOREIGN PATENT DOCUMENTS

| | | |
|---|---|---|
| JP | S63-103135 | 5/1988 |
| JP | 2001-304001 | 10/2001 |

(Continued)

OTHER PUBLICATIONS

International Search Report for PCT/JP2020/008170 mailed on Jun. 2, 2020.

*Primary Examiner* — Krishnan Ramesh
(74) *Attorney, Agent, or Firm* — IPUSA, PLLC

(57) ABSTRACT

A work machine includes a traveling body, a work attachment, and a processing circuitry configured to receive a reservation of an execution of a predetermined function in accordance with an input received by the work machine or in accordance with a signal received from an external apparatus and execute the predetermined function of the reservation, based on an execution condition designated by the reservation.

14 Claims, 11 Drawing Sheets

(56) References Cited

U.S. PATENT DOCUMENTS

| | | | | |
|---|---|---|---|---|
| 2014/0379209 | A1* | 12/2014 | Matsuda | B60L 58/16 701/34.2 |
| 2015/0147147 | A1* | 5/2015 | Uchiyama | E02F 9/2033 414/685 |
| 2017/0050617 | A1* | 2/2017 | Penilla | B60R 25/2018 |
| 2017/0240181 | A1* | 8/2017 | Yu | B60R 25/00 |
| 2017/0275853 | A1 | 9/2017 | Funabiki et al. | |
| 2018/0334136 | A1* | 11/2018 | Chaston | G06V 20/56 |
| 2019/0277004 | A1 | 9/2019 | Hashimoto et al. | |
| 2020/0032484 | A1* | 1/2020 | O'Donnell | E02F 9/205 |
| 2021/0004895 | A1* | 1/2021 | Kuriyagawa | G06Q 50/40 |
| 2021/0150887 | A1* | 5/2021 | Takegoshi | G08G 1/123 |
| 2021/0159725 | A1* | 5/2021 | Hsia | G01R 31/3835 |
| 2021/0363728 | A1* | 11/2021 | Bramberger | G06F 8/65 |
| 2021/0375108 | A1* | 12/2021 | Dobashi | G08B 13/1427 |
| 2021/0381195 | A1* | 12/2021 | Mura | E02F 9/2228 |

FOREIGN PATENT DOCUMENTS

| | | |
|---|---|---|
| JP | 2003-096832 | 4/2003 |
| JP | 2013-147881 | 8/2013 |
| JP | 2016-065637 | 4/2016 |
| JP | 2016-130409 | 7/2016 |
| JP | 2018-028212 | 2/2018 |
| JP | 2018-070339 | 5/2018 |
| WO | 2005/043481 | 5/2005 |

* cited by examiner

FIG.7

| RESERVATION TARGET FUNCTION | | EXECUTION CONDITION |
|---|---|---|
| HEATING OPERATION FUNCTION | | TEMPORAL CONDITION |
| | | TEMPORAL CONDITION and ENVIRONMENT CONDITION |
| AUTOMATIC TASK FUNCTION | | TEMPORAL CONDITION |
| | | TEMPORAL CONDITION and/or OPERATION SITUATION CONDITION |
| SELF-DIAGNOSIS FUNCTION | | TEMPORAL CONDITION |
| | | TEMPORAL CONDITION and/or OPERATION SITUATION CONDITION |
| OPERATION RESTRICTION FUNCTION | OPERATION TIME RE-STRICTION FUNCTION | TEMPORAL CONDITION |
| | OUTPUT RESTRICTION FUNCTION | TEMPORAL CONDITION |
| | | TEMPORAL CONDITION and/or (OPERATION SITUATION CONDITION and/or ENVIRONMENT CONDITION) |
| | AIR-CONDITIONING RESTRICTION FUNCTION | TEMPORAL CONDITION |
| | | TEMPORAL CONDITION and/or ENVIRONMENT CONDITION |

WORK MACHINE AND INFORMATION PROCESSING APPARATUS

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/008170, filed on Feb. 27, 2020, and designating the U.S., which claims priority to Japanese Patent Application No. 2019-036481 filed on Feb. 28, 2019. The entire contents of the foregoing applications are incorporated herein by reference.

BACKGROUND

Technical Field

The present disclosure relates to a work machine and the like.

Description of Related Art

For example, work machines such as a shovel and a crane are known.

SUMMARY

An aspect of the present disclosure provides a work machine that includes a traveling body, a work attachment, and a processing circuitry configured to receive a reservation of an execution of a predetermined function in accordance with an input received by the work machine or in accordance with a signal received from an external apparatus and execute the predetermined function of the reservation, based on an execution condition designated by the reservation.

Another aspect of the present disclosure provides an information processing apparatus that includes a processing circuitry configured to receive a reservation of an execution of a predetermined function of a work machine including a traveling body and a work attachment, in accordance with an input received by the information processing apparatus or in accordance with a signal received from an external apparatus, wherein the processing circuitry is configured to cause the work machine to perform the predetermined function of the reservation, based on a condition designated by the reservation, by transmitting a signal for requesting the reservation to the work machine.

BRIEF DESCRIPTION OF THE DRAWINGS

FIG. 7 is a drawing for explaining a fifth example (a reservation function related to execution of multiple reservation target functions) of the reservation function.

EMBODIMENT OF THE INVENTION

For example, work machines such as a shovel and a crane are known.

However, most of the operations of work machines at a work site is achieved by human intervention, e.g., by operators and managers. Therefore, for example, in order to start a task at a scheduled time, the operator has to turn ON the key switch of the work machine some time before the scheduled time to start the engine warm-up of the work machine such as a shovel. Also, when it is desired to strictly manage the time period in which the work machine is permitted to operate in view of environments such as noises, the managers have to check, at the actual work site, whether the work machine is used other than in the time period in which the work machine is permitted to operate. Therefore, there is room for improvement associated with the efficiency of operation of the work machine.

Accordingly, in view of the above problems, it is desired to provide a technique capable of supporting more efficient operation of the work machine.

Hereinafter, an embodiment will be described with reference to drawings.

[Overview of Task Support System]

First, an overview of a task support system SYS according to the present embodiment is described with reference to FIG. 1.

Figure 1:
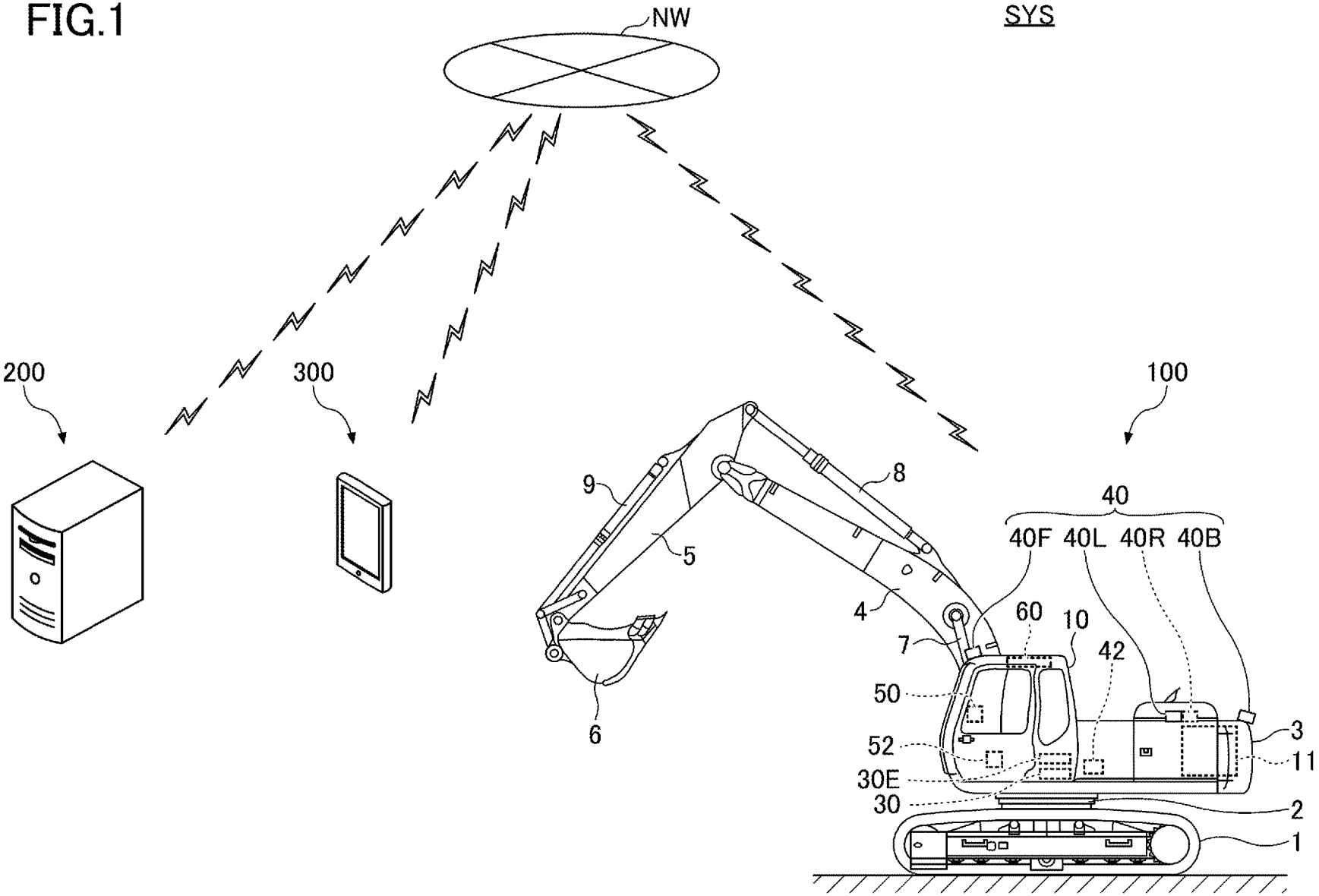
FIG. 1 is a drawing illustrating an overview of a task support system.

FIG. 1 is a schematic diagram illustrating an example of the task support system SYS according to the present embodiment.

The task support system SYS includes a shovel 100, a management apparatus 200, and a support terminal 300. The task support system SYS supports execution of various tasks of the shovel 100 through the management apparatus 200 and the support terminal 300.

The task support system SYS may include a single shovel 100 or multiple shovels 100. Specifically, the management apparatus 200 and the support terminal 300 may provide support in tasks to a single shovel 100 or multiple shovels 100. Also, the task support system SYS may include a single management apparatus 200 or multiple management apparatuses 200, and may include a single support terminal 300 or multiple support terminals 300.

One shovel 100 or either some or all of multiple shovels 100 included in the task support system SYS may be replaced with other work machines. In other words, the above reservation function may be applied to any work machine other than the shovel 100, and the management apparatus 200 and the support terminal 300 may be configured to provide support in various tasks of any given work machine, instead of or in addition to the shovel 100. Examples of other work machines include a lifting magnet machine with a lifting magnet attached as an end attachment, a mobile crane, a bulldozer, a wheel loader, an asphalt finisher, forestry machinery, and the like.

<Overview of Shovel>

A shovel 100 (an example of a work machine) according to the present embodiment includes a lower traveling body 1, an upper turning body 3 turnably mounted on the lower traveling body 1 with a turning mechanism 2, a boom 4, an arm 5, a bucket 6, and a cab 10. The boom 4, the arm 5, and the bucket 6 constitute an attachment. Hereinafter, the front side of the shovel 100 corresponds to the extension direction of the attachment with respect to the upper turning body 3, when the shovel 100 is seen from immediately above along the turning axis of the upper turning body 3 in a plan view (hereinafter simply referred to as a "plan view"). The left side and the right side of the shovel 100 correspond a left side and a right side, respectively, as seen from the operator in the cab 10.

The lower traveling body 1 includes, for example, a pair of right and left crawlers. The crawlers are hydraulically driven by traveling hydraulic motors 1L, 1R (see FIG. 2A, FIG. 2B), to cause the shovel 100 to travel.

The upper turning body 3 is driven by the turning mechanism 2 with a turning hydraulic motor 2A (FIG. 2A, FIG. 2B) to turn with respect to the lower traveling body 1.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5 to be able to pivot vertically.

The boom 4, the arm 5, and the bucket 6 are hydraulically driven by a boom cylinder 7, an arm cylinder 8, and a bucket cylinder 9, respectively, serving as hydraulic actuators.

The cab 10 is an operation room in which a user of the shovel 100 such as an operator rides, and is mounted on the front left of the upper turning body 3. Examples of shovel users may include an operator of the shovel 100, a serviceman who performs maintenance of the shovel 100, an owner of the shovel 100, a manager of the shovel 100, and the like.

Also, in accordance with a predetermined input from the shovel user of the shovel 100, the shovel 100 according to the present embodiment receives a reservation related to a predetermined function (hereinafter referred to as a "reservation target function") of the shovel 100, and executes the reservation target function in accordance with a condition designated by the received reservation. Hereinafter, this function of the shovel 100 is referred to as a "reservation function". For example, the reservation target function may include a function (hereinafter referred to as an "engine warm-up function") for performing engine warm-up by automatically starting the shovel 100 (an example of a predetermined function). The reservation target function may include a function (hereinafter referred to as an "automatic task function") for causing the shovel 100 to automatically execute a predetermined task (an example of a predetermined function). In addition, for example, the reservation target function may include a function (hereinafter referred to as a "function of self-diagnosis") for causing the shovel 100 to perform self-diagnosis (an example of a predetermined function). In addition, for example, the reservation target function may include a function (hereinafter referred to as an "operation restriction function") for restricting the movement of the shovel 100 (an example of a predetermined function). The details of the reservation function of the shovel 100 are explained later (see FIG. 3 to FIG. 6).

Also, the shovel 100 according to the present embodiment includes a communication apparatus 60, and is communicably connected to an external apparatus such as the management apparatus 200 via a communication network NW. For example, the communication network NW may include a wide area network (WAN). For example, the wide area network may include a mobile communication network including a base station as a terminal end. In addition, for example, the wide area network may include a satellite communication network using a communications satellite. In addition, for example, the wide area network may include the Internet. In addition, for example, the wide area network may include a wired or wireless local network (LAN). For example, the local network may include a predetermined short-range communication network such as WiFi, Bluetooth (registered trademark), and the like. Through the communication network NW, the shovel 100 receives and transmits various types of signals by receiving various types of signals (for example, an information signal, a control signal, and the like) from the management apparatus 200 and by transmitting various types of signals to the management apparatus 200. As a result, the shovel 100 can receive support in various types of tasks from the management apparatus 200.

For example, the shovel 100 receives an instruction signal related to the reservation function (hereinafter referred to as a "reservation instruction signal") from the management apparatus 200. Then, the shovel 100 receives a reservation related to execution of the reservation target function designated by the reservation instruction signal in accordance with the reservation instruction signal. Accordingly, in accordance with the reservation from the management apparatus 200, the shovel 100 can automatically execute the reservation target function without relying on an input such as an operation on the side of the shovel 100.

<Overview of Management Apparatus>

The management apparatus 200 (an example of an information processing apparatus) provides support in various types of tasks of the shovel 100. For example, the management apparatus 200 may be a cloud server in a management center or the like outside of the work site of the shovel 100. For example, the management apparatus 200 may be an edge server that is located in a temporary office in the work site of the shovel 100 or at a position relatively close to the work site (for example, a base station, a communication center, or the like). For example, the management apparatus 200 may be a terminal apparatus in the work site. The terminal apparatus may be a non-mobile terminal apparatus such as a desktop computer terminal provided in a temporary office in the work site of the shovel 100. For example, the management apparatus 200 may be a mobile terminal such as a smartphone, a tablet terminal, a laptop computer, or the like.

The management apparatus 200 can communicatively connected to the shovel 100 through the communication network NW. For example, the management apparatus 200 may transmit and receive various types of signals to and from the shovel 100 by transmitting an information signal or a control signal to the shovel 100 and by receiving an information signal from the shovel 100. Accordingly, the management apparatus 200 can provide support in various types of tasks of the shovel 100 from the outside, through transmission and reception of signals to and from the shovel 100.

For example, as described above, the management apparatus 200 transmits a reservation instruction signal to the shovel 100, and can cause the shovel 100 to automatically execute the reservation target function in accordance with a condition designated by the reservation instruction signal.

<Overview of Support Terminal>

The support terminal 300 (an example of an information processing apparatus) provides support in various types of tasks of the shovel 100 through the management apparatus 200, on the basis of an operation performed by the user (hereinafter referred to as a "support terminal user") such as a worker, a supervisor, or the like of the work site where the shovel 100 is used. For example, the support terminal 300 may be a mobile terminal such as a smartphone, a tablet terminal, a laptop computer terminal, or the like. For example, the support terminal 300 may be a stationary terminal such as a desktop computer terminal provided in a management office in the work site.

For example, the support terminal 300 is communicably connected to the management apparatus 200 via the communication network NW. For example, the support terminal 300 may transmit and receive various types of signals to and from the shovel 100 by transmitting an information signal or a control signal to the shovel 100 and by receiving an information signal from the shovel 100 through the management apparatus 200. Accordingly, the support terminal 300 can provide support in various types of tasks of the shovel 100 from the outside, through transmission and reception of signals to and from the shovel 100.

For example, the support terminal 300 can transmit a reservation instruction signal to the shovel 100 through the management apparatus 200, and can cause the shovel 100 to automatically execute a predetermined function according to a condition designated by the reservation instruction signal.

It should be noted that the support terminal 300 may directly communicate with the shovel 100 through the communication network NW.

[Configuration of Task Support System]

Figure 2A:
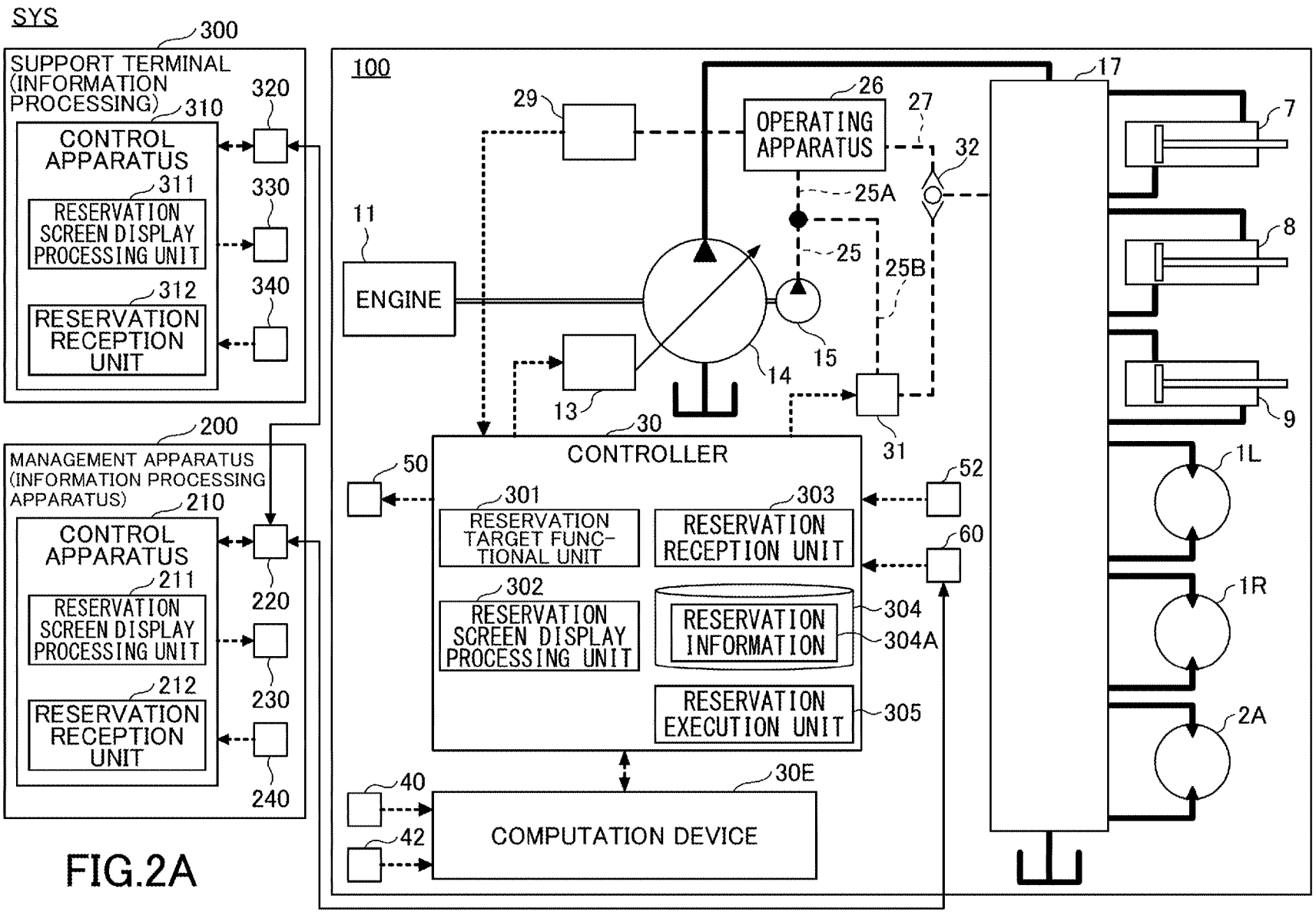
FIG. 2A is a block diagram illustrating an example of configuration of the task support system.
Figure 2B:
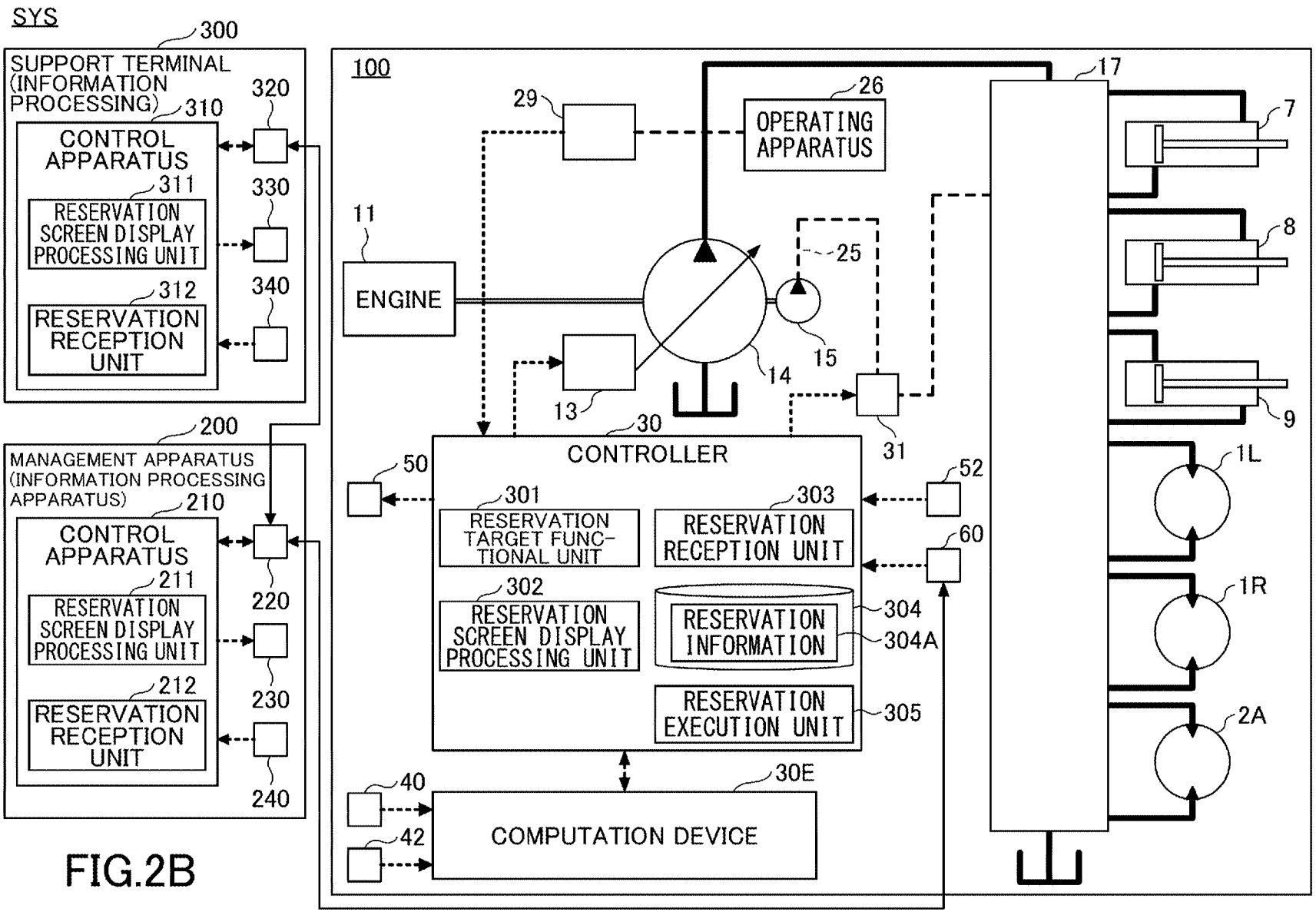
FIG. 2B is a block diagram illustrating another example of configuration of the task support system.

Next, a specific configuration of the task support system SYS is explained with reference to not only FIG. 1 but also FIG. 2 (FIG. 2A, FIG. 2B).

FIG. 2A, FIG. 2B are block diagrams respectively illustrating an example of configuration and another example of configuration of the task support system SYS according to the present embodiment. FIG. 2A and FIG. 2B are different from each other only in the configuration of the shovel 100 among the shovel 100, the management apparatus 200, and the support terminal 300.

In the drawings, a mechanical power line, a high-pressure hydraulic line, a pilot line, and an electric drive and control system are indicated by a double line, a thick solid line, a dashed line, and a dotted line, respectively.

<Configuration of Shovel>

<<Hydraulic Driving System>>

As described above, the hydraulic driving system of the shovel 100 according to the present embodiment includes the hydraulic actuators for hydraulically driving the lower traveling body 1, the upper turning body 3, the boom 4, the arm 5, the bucket 6, and the like. As described above, the hydraulic actuators include the traveling hydraulic motors 1L, 1R, the turning hydraulic motor 2A, the boom cylinder 7, the arm cylinder 8, the bucket cylinder 9, and the like. The hydraulic driving system of the shovel 100 according to the present embodiment includes an engine 11, a regulator 13, a main pump 14, and a control valve unit 17.

The engine 11 is a main power source in the hydraulic drive system, and is, for example, a diesel engine using light oil as fuel. The engine 11 is mounted on the rear part of the upper turning body 3, for example. Specifically, under direct or indirect control by a controller 30 explained later, the engine 11 rotates constantly at a preset target rotational speed, and drives the main pump 14 and a pilot pump 15.

The regulator 13 controls the amount of discharge of the main pump 14 under the control of the controller 30. For example, the regulator 13 adjusts the angle (hereinafter referred to as a "tilt angle") of a swashplate of the main pump 14 according to a control instruction given by the controller 30.

The main pump 14 is mounted, for example, on the rear part of the upper turning body 3, similarly with the engine 11, and supplies hydraulic oil to the control valve unit 17 through a high-pressure hydraulic line. The main pump 14 is driven by the engine 11 as described above. The main pump 14 is, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled.

The control valve unit 17 is a hydraulic control device that is installed, for example, at the center of the upper turning body 3, and that controls the hydraulic actuators according to operator's operation state with the operating apparatus 26 or according to a control instruction corresponding to automatic movement of the shovel 100 (hereinafter referred to as an "automatic control instruction") that is output from the controller 30. The control valve unit 17 is connected to the main pump 14 via the high-pressure hydraulic line as described above, and hydraulic oil supplied from the main pump 14 is selectively supplied to the hydraulic actuator (the traveling hydraulic motors 1L, 1R, the turning hydraulic motor 2A, the boom cylinder 7, the arm cylinder 8, the bucket cylinder 9, and the like) according to operator's operation state with the operating apparatus 26 or according to the automatic control instruction that is output from the controller 30. Specifically, the control valve unit 17 includes multiple control valves (which are also referred to as direction switch valves) that control the flowrates and the flow directions of hydraulic oil supplied from the main pump 14 to the respective hydraulic actuators.

<<Operation System>>

The operating system related to the hydraulic driving system of the shovel 100 according to the present embodiment includes a pilot pump 15 and an operating apparatus 26. As illustrated in FIG. 2A, the operating system related to the hydraulic driving system of the shovel 100 includes a shuttle valve 32, in a case where the operating apparatus 26 is of a hydraulic pilot type.

The pilot pump 15 is installed, for example, on the rear part of the upper turning body 3 in a manner similarly to the engine 11, and applies a pilot pressure to various hydraulic apparatuses via a pilot line 25. For example, the pilot pump 15 is a fixed displacement hydraulic pump, and is driven by the engine 11 as described above.

The operating apparatus 26 is provided near the operator's seat of the cab 10, and is operation input means allowing the operator to operate various types of driving elements (such as the lower traveling body 1, the upper turning body 3, the boom 4, the arm 5, the bucket 6, and the like). In other words, the operating apparatus 26 is operation input means with which the operator operates the hydraulic actuator (i.e., the traveling hydraulic motors 1L, 1R, the turning hydraulic motor 2A, the boom cylinder 7, the arm cylinder 8, the bucket cylinder 9, and the like) for driving the respective driven elements. For example, the operating apparatus 26 includes lever devices for operating the boom 4 (the boom cylinder 7), the arm 5 (the arm cylinder 8), the bucket 6 (the bucket cylinder 9), and the upper turning body 3 (the turning hydraulic motor 2A). In addition, for example, the operating apparatus 26 includes pedal devices or lever devices for operating the left and right crawlers (the traveling hydraulic motors 1L, 1R) of the lower traveling body 1.

For example, as illustrated in FIG. 2A, the operating apparatus 26 is of a hydraulic pilot type. Specifically, the operating apparatus 26 uses hydraulic oil supplied from the pilot pump 15 through the pilot line 25 and a pilot line 25A branched from the pilot line 25, to output the pilot pressure according to the operation state to a pilot line 27 on its secondary side. The pilot line 27 is connected via the shuttle valve 32 to the control valve unit 17. Accordingly, the control valve unit 17 receives via the shuttle valve 32 a pilot pressure corresponding to the operation state of each of various driven elements (hydraulic actuators) with the operating apparatus 26. Accordingly, the control valve unit 17 can drive each of the hydraulic actuators according to the operation state of the operating apparatus 26 by the operator and the like.

For example, as illustrated in FIG. 2B, the operating apparatus 26 is an electric type. Specifically, the operating apparatus 26 outputs an electric signal (hereinafter referred to as an "operation signal") according to the operation content, and the operation signal is retrieved by the controller 30. Then, the controller 30 outputs the content of the operation signal, i.e., a control instruction according to the operation content that is input to the operating apparatus 26 (hereinafter referred to as an "operation control instruction" so as to be distinguished from an automatic control instruction) to a proportional valve 31. Accordingly, the pilot pressure according to the operation state that is input to the operating apparatus 26 is input from the proportional valve 31 to the control valve unit 17, and the control valve unit 17 can drive each of the hydraulic actuators in accordance with the operation state that is input to the operating apparatus 26 by the operator and the like.

A control valve (a direction switch valve) provided in the control valve unit 17 may be of an electromagnetic solenoid type. In this case, an electric signal that is output from the operating apparatus 26 may be directly input to the control valve unit 17, i.e., the control valve of the electromagnetic solenoid type.

As illustrated in FIG. 2A, the shuttle valve 32 includes two inlet ports and one output port, and is configured to output, from the output port, a hydraulic oil having a higher pump pressure from among the pump pressures applied to the two inlet ports. The shuttle valve 32 is provided for each of the driven elements (the left and right crawlers, the upper turning body 3, the boom 4, the arm 5, the bucket 6, and the like) that is to be operated with the operating apparatus 26. One of the two inlet ports of the shuttle valve 32 is connected to the operating apparatus 26 (specifically, the lever devices or pedal devices explained above included in the operating apparatus 26), and the other of the two inlet ports of the shuttle valve 32 is connected to the proportional valve 31. The output port of the shuttle valve 32 is connected to the pilot port of the corresponding control valve (specifically, the control valve corresponding to the hydraulic actuator that is to be operated with the lever devices or pedal devices explained above connected to one of the inlet ports of the shuttle valve 32) in the control valve unit 17 through the pilot line. Therefore, each of the shuttle valves 32 can apply one of the pump pressure generated by the operating apparatus 26 and the pump pressure generated by the proportional valve 31, whichever is higher, to the pilot port of the corresponding control valve. In other words, the controller 30 outputs, from the proportional valve 31, a pump pressure higher than the secondary-side pump pressure output from the operating apparatus 26 to control the corresponding control valve without relying on the operation of the operating apparatus 26 by the operator. Therefore, the controller 30 can automatically control the operation of the driven element (the lower traveling body 1, the upper turning body 3, the attachment, and the like) without relying on the operation state of the operating apparatus 26 by the operator.

<<Control System>>

The control system of the shovel 100 according to the present embodiment includes the controller 30, a computation device 30E, a proportional valve 31, an ambient information obtaining apparatus 40, a shovel information obtaining apparatus 42, a display apparatus 50, an input apparatus 52, and a communication apparatus 60. As illustrated in FIG. 2A, the control system of the shovel 100 according to the present embodiment includes an operation pressure sensor 29, in a case where the operating apparatus 26 is of a hydraulic pilot type.

The controller 30 performs various controls of the shovel 100. The functions of the controller 30 may be achieved by any given hardware, a combination of hardware and software, and the like. For example, the controller 30 is mainly constituted by a microcomputer including a CPU (Central Processing Unit), a memory device such as a RAM (Random Access Memory), a nonvolatile auxiliary storage device such as a ROM (Read Only Memory), and interface devices, and the like. This is also applicable to control apparatuses 210, 310 explained below. For example, the controller 30 includes, as functional units achieved by causing the CPU to execute the one or more programs installed on the auxiliary storage device, a reservation target functional unit 301, a reservation screen display processing unit 302, a reservation reception unit 303, and a reservation execution unit 305. The controller 30 uses the reservation information storage unit 304 and the like. For example, the reservation information storage unit 304 may be achieved by an auxiliary storage device, a communicably connected external storage device, or the like.

Specifically, the controller 30 controls the proportional valve 31 (specifically, outputs an automatic control instruction to the proportional valve 31), according to a result of computation of the computation device 30E, i.e., on the basis of a driving instruction of a hydraulic actuator, so that the shovel 100 automatically moves without relying on the operation performed by the operator.

Some of the functions of the controller 30 may be achieved by another controller (a control apparatus). In other words, the functions of the controller 30 may be achieved as being distributed among multiple controllers.

The computation device 30E performs computation processing related to various functions of the controller 30 under the control of the controller 30. The functions of the computation device 30E may be achieved by any given hardware, a combination of hardware and software, and the like. For example, the computation device 30E may include a GPU (Graphical Processing Unit), an ASIC (Application Specific Integrated Circuit), an FPGA (field-programmable gate array), and the like to achieve high-speed computation processing. The controller 30 and the computation device 30E are examples of a processing circuitry.

Specifically, the computation device 30E may recognize the situation around the shovel 100 (the shovel in question) on the basis of output information of the ambient information obtaining apparatus 40. For example, the computation device 30E may recognize an object around the shovel 100 and recognize the distance to the object. Also, the computation device 30E may recognize the position of the shovel 100 and the orientation state of the shovel 100 (for example, the orientation state of the attachment, the orientation state of the upper turning body 3, and the like) on the basis of the output information of the shovel information obtaining apparatus 42. Then, the computation device 30E may calculate and generate driving instructions of hydraulic actuators for automatically moving the shovel 100 on the basis of the recognized ambient situations around the shovel 100 and various types of states of the shovel 100.

For example, the computation device 30E can also recognize the position of the shovel 100 and the orientation state of the upper turning body 3 (for example, the inclination state and the turning state) on the basis of a change in position of an object around the shovel 100 (the shovel in question) that is recognized on the basis of the output information of the ambient information obtaining apparatus 40. For example, in a case where the attachment of the shovel 100 and the position thereof can be recognized from the output information of the ambient information obtaining apparatus 40, the computation device 30E can recognize the orientation state of the attachment on the basis of the output information of the ambient information obtaining apparatus 40. Therefore, the shovel information obtaining apparatus 42 may be omitted, if other conditions (for example, recognition accuracy or the like) are met.

The proportional valve 31 is provided for each of the driven elements (the left and right crawlers, the upper turning body 3, the boom 4, the arm 5, and the bucket 6) to be operated with the operating apparatus 26. The proportional valve 31 is provided in the pilot line 25 (the pilot line 25B branched from the pilot line 25 in the case of FIG. 2A) connecting the pilot pump 15 and the control valve unit 17, and configured to be able to change the size of area of flow (i.e., the size of a cross-sectional area in which hydraulic oil can flow). Accordingly, the proportional valve 31 can output a predetermined pilot pressure to the secondary side by using hydraulic oil of the pilot pump 15 supplied through the pilot line 25 (the pilot line 25B). Therefore, via the shuttle valve 32 as illustrated in FIG. 2A, or directly as illustrated in FIG. 2B, the proportional valve 31 can apply, to the control valve unit 17, the predetermined pilot pressure according to the control instruction from the controller 30. Specifically, the controller 30 outputs, to the proportional valve 31, an operation control instruction according to an electric signal from the operating apparatus 26 of the electric type, so that, the pilot pressure according to the operation content of the operating apparatus 26 from the proportional valve 31 is supplied to the control valve unit 17, and the movement of the shovel 100 based on the operator's operation can be achieved. Even in a case where the operator is not operating the operating apparatus 26, the controller 30 outputs, to the proportional valve 31, the automatic control instruction to supply a predetermined pilot pressure from the proportional valve 31 to the control valve unit 17, so that the remote operation function and the automation of the shovel 100 can be achieved.

The ambient information obtaining apparatus 40 outputs information about the situation of the three-dimensional space around the shovel 100 (specifically, detection information about an object around the shovel 100 and the position thereof). The ambient information obtaining apparatus 40 may include, for example, an ultrasonic sensor, a millimeter-wave radar, a monocular camera, a stereo camera, a depth camera, a LIDAR (Light Detection and Ranging) device, a distance image sensor, an infrared sensor, or the like. In the present embodiment, the ambient information obtaining apparatus 40 includes a front sensor 40F mounted at the front on an upper surface of the cab 10, a rear sensor 40B mounted at the rear on an upper surface of the upper turning body 3, a left sensor 40L mounted at the left on the upper surface of the upper turning body 3, and a right sensor 40R mounted at the right on the upper surface of the upper turning body 3. In addition, an upper sensor, configured to output information related to the state of the three-dimensional space above the upper turning body 3 (for example, detection information about an object located above the upper turning body 3), may be mounted on the shovel 100. Some or all of the rear sensor 40B, the left sensor 40L, the right sensor 40R, and the upper sensor may be omitted, depending on the performance required for automatic movement of the shovel 100. The output information of the ambient information obtaining device 40 is input to the computation device 30E.

The shovel information obtaining apparatus 42 obtains information about various types of states (for example, states such as the position, direction, orientation, and the like of the shovel 100) from the shovel 100 (the shovel in question). For example, the shovel information obtaining apparatus 42 may include a positioning device (for example, a Global Navigation Satellite System (GNSS) module or the like) configured to acquire the information related to the position of the shovel 100. Also, the shovel information obtaining apparatus 42 may include an orientation sensor configured to acquire information about an orientation state (for example, an orientation angle about a rotation axis) of each of the boom 4, the arm 5, and the bucket 6 of the attachment, and an orientation sensor configured to detect an orientation state (for example, an inclination angle and a turning angle) of the upper turning body 3. In this case, the orientation sensors may include a rotary encoder, an acceleration sensor, an angular acceleration sensor, a 6-axis sensor, an Inertial Measurement Unit (EMU), or the like, for example. In addition, the orientation sensors for the attachments may include a cylinder sensor configured to detect a cylinder position of the boom cylinder 7, the arm cylinder 8, the bucket cylinder 9, or the like. The output information of the shovel information obtaining apparatus 42 is input to the computation device 30E.

The display apparatus 50 is provided at a position that can be easily seen by the operator who sits on the seat in the cab 10, and displays various kinds of information images. The display apparatus 50 is, for example, a liquid crystal display and an organic EL (electroluminescent) display.

The input apparatus 52 is provided in the cab 10 to receive inputs from the shovel user such as the operator. For example, the input apparatus 52 may include an operation input apparatus that is provided in an area that can be reached by the operator who sits on the seat in the cab 10 and that receives various kinds of operation inputs from the operator. For example, the operation input apparatus may include hardware input means such as a touch panel implemented in the display apparatus 50, a touch pad, button switches, levers, and toggle levers provided around the display apparatus 50, knob switches provided in the operating apparatus 26, and the like. The operation input apparatus may include software input means operable by hardware input means, such as virtual operation targets (for example, operation icons) and the like displayed on various operation screens displayed on the display apparatus 50. The input apparatus 52 may include, for example, an audio input apparatus configured to receive an audio input by the shovel operator, a gesture input apparatus and the like configured to receive a gesture input from the shovel user. The audio input apparatus may include, for example, a microphone for obtaining speech of the shovel user. The gesture input apparatus may include, for example, an indoor camera capable of capturing images indicating a gesture of the shovel operator. A signal corresponding to an input content to the input apparatus 52 is retrieved by the controller 30.

The communication apparatus 60 is connected to a predetermined communication network which may include a mobile communication network having a base station at a terminal end, a satellite communication network using a communication satellite, the Internet, or the like, for example, and communicates with an external device (for example, a management apparatus 200) external to the shovel 100. The communication apparatus 60 may be a mobile communication module which is in conformance with a predetermined mobile communication standard, such as the 3rd Generation (3G), the 4th Generation (4G), the Long Term Evolution (LTE), the 5th Generation (5G), or the like, for example.

As illustrated in FIG. 2A, the operation pressure sensor 29 detects the pilot pressure on the secondary side (pilot line 27) of the operating apparatus 26, that is, the pilot pressure corresponding to the operation state of the respective driven elements (hydraulic actuators) in the operating apparatus 26. A pilot pressure detection signal, output from the operation pressure sensor 29, and corresponding to the operation state of the lower traveling body 1, the upper turning body 3, the boom 4, the arm 5, the bucket 6, or the like in the operating apparatus 26, is input to the controller 30.

The reservation target functional unit 301 executes the reservation target function.

For example, the reservation target functional unit 301 may include an engine warm-up functional unit. The engine warm-up functional unit may cause the shovel 100 to perform the engine warm-up by automatically turning the key switch of the shovel 100 from OFF to ON and causing the engine 11 to run at a predetermined idle speed.

In addition, for example, the reservation target functional unit 301 may include an automatic task functional unit that executes an automatic task function. The automatic task functional unit controls the proportional valve 31 (specifically, outputs an automatic control instruction to the proportional valve 31), according to a result of computation of the computation device 30E, i.e., on the basis of a driving instruction of a hydraulic actuator, so that the shovel 100 automatically moves without relying on the operation performed by the operator. Specifically, the automatic task functional unit may achieve an automatic task of the shovel 100 by outputting the automatic control instruction to the proportional valve 31 and causing the hydraulic actuators to move automatically, so that the automatic task of the shovel 100 is achieved.

Furthermore, for example, the reservation target functional unit 301 may include a function of self-diagnosis unit that executes a function of self-diagnosis. Through a conventionally known self-diagnosis algorithm, the function of self-diagnosis unit may diagnose whether there is abnormality or malfunction in the apparatuses and devices in the shovel 100 (for example, the engine 11 including an intake system and an exhaust system, various hydraulic devices such as the control valve unit 17, various control devices such as the controller 30, various communication devices such as the communication apparatus 60, various sensors, various actuators, various display devices such as the display apparatus 50 and warning lamps, and the like).

In addition, for example, the reservation target functional unit 301 may include an operation restriction functional unit that executes the operation restriction function. The operation restriction functional unit restricts various movements of the shovel 100. For example, the operation restriction functional unit may execute a function (hereinafter referred to as an "operation time restriction function") for restricting a time period (hereinafter referred to as an "operation-permitted time period") in which the shovel 100 is permitted to operate (work). In other words, the operation restriction functional unit may prevent the shovel 100 from starting in a time period other than the operation-permitted time period, and may forcibly stop the shovel 100 that is operating in a time period other than the operation-permitted time period. In a case where the shovel 100 (the shovel in question) is operating in a time period other than the operation-permitted time period, the operation restriction functional unit may stop the shovel 100 upon automatically moving the shovel 100 to a predetermined location (for example, a parking location defined in advance in the work site). Also, in a case where the shovel 100 (the shovel in question) is operating in a time period other than the operation-permitted time period, the operation restriction functional unit may notify the shovel user to prompt the shovel user to move the shovel 100 to a predetermined location (for example, the parking location described above) through predetermined notification means (for example, a speaker and the like of the display apparatus 50 or in the cab 10). In this case, the operation restriction functional unit may forcibly stop the shovel 100 after the shovel 100 has been moved to the predetermined location. For example, the operation restriction functional unit may execute a function (hereinafter referred to as an "output restriction function") for restricting the movement of the shovel 100 by controlling the engine 11 and the hydraulic actuators of the shovel 100 to relatively reduce the output of the shovel 100 (for example, an excavation force and the like during an excavation task). Specifically, in a case where multiple selectable driving modes (for example, a first mode in which the work efficiency is given the highest priority, a second mode in which both of the work efficiency and the fuel consumption are achieved, and a third mode in which the fuel consumption is given the highest priority) are defined in the shovel 100, the operation restriction functional unit may impose a restriction so that only some of the driving modes (for example, the second mode and the third mode) with a relatively low output are available. For example, the operation restriction functional unit may execute a function (hereinafter referred to as an "air conditioning restriction function") for restricting the temperature setting of the cooling operation by the air conditioning apparatus provided in the cab 10 (an example of an operator's room).

The reservation screen display processing unit 302 causes the display apparatus 50 to display an operation screen (hereinafter referred to as a "reservation reception screen") for receiving a reservation related to the reservation target function of the shovel 100 and an operation screen (hereinafter referred to as a "reservation confirmation screen") for confirming the content of the received reservation. Hereinafter, screens related to the reservation function such as a reservation reception screen, a reservation confirmation screen, a shovel operator selection screen, and the like are collectively referred to as "reservation screens". When the operator performs a predetermined operation on the reservation screen through the input apparatus 52, the operator can make reservation related to the reservation target function, and confirm the content of the received reservation.

The reservation reception unit 303 receives a reservation related to the reservation target function of the shovel 100 (the shovel in question) in accordance with an operator's operation on the reservation reception screen of the display apparatus 50 using the input apparatus 52. Also, the reservation reception unit 303 receives the reservation related to the reservation target function according to a reservation instruction signal received from the management apparatus 200 through the communication apparatus 60. The content of the reservation received by the reservation reception unit 303 includes: a type of a reservation target function executed in association with the received reservation; and a condition for executing a target function (hereinafter referred to as an "execution condition"). The execution condition may include: a condition related to time that may include date and time, a day of week, a duration, and the like (hereinafter referred to as a "temporal condition"); a condition of an operation situation of the shovel 100 (the shovel in question) (hereinafter referred to as an "operation situation condition"); a condition related to the environment around the shovel (hereinafter referred to as an "environment condition"); and the like. The execution condition includes a condition related to operator's attendance (for example, whether or not the operator who is scheduled to operate the shovel 100 is late for the work or is taking a vacation due to poor physical condition such as having a cold). In this case, for example, information about attendance may be received from the management apparatus 200 through the communication apparatus 60. Information (hereinafter referred to as "reservation information") 304A about the content of the reservation received by the reservation reception unit 303 is registered (stored) into the reservation information storage unit 304.

The reservation information storage unit 304 stores the reservation information 304A. For example, records including identification information (hereinafter referred to as "reservation identification information") defined for each reservation received by the reservation reception unit 303 (for example, an unique reservation identifier (ID) and the like assigned for each reservation) and the reservation information 304A (the type and execution conditions of the reservation target function, and the like) corresponding to the reservation identification information may be stored into the reservation information storage unit 304, so that a group of records of the reservation information 304A, i.e., a database, may be established.

The reservation information 304A registered to the reservation information storage unit 304 may be uploaded to the management apparatus 200 in an automatic manner or in response to a request from the management apparatus 200. Accordingly, workers and managers of the management apparatus 200, the user of the support terminal 300 communicably connected to the management apparatus 200, and the like can ascertain (confirm) the reservation information registered to the reservation information storage unit 304.

The reservation execution unit 305 causes the reservation target function designated by the reservation information 304A to be automatically executed in accordance with the execution condition designated by the reservation information 304A for each piece of the reservation information 304A registered to the reservation information storage unit 304. Specifically, the reservation execution unit 305 causes the reservation target function to be executed by starting the reservation target functional unit 301 corresponding to the reservation target function designated by the reservation information 304A in accordance with the execution condition designated by the reservation information 304A.

<Configuration of Management Apparatus>

The management apparatus 200 includes a control apparatus 210, a communication apparatus 220, a display apparatus 230, and an input apparatus 240.

The control apparatus 210 performs various types of controls related to the management apparatus 200. For example, the control apparatus 210 includes, as functional units achieved by causing the CPU to execute the one or more programs installed on the auxiliary storage device, a reservation screen display processing unit 211 and a reservation reception unit 212.

The communication apparatus 220 connects to the communication network NW, and communicates with an external apparatus such as the shovel 100, the support terminal 300, and the like through the communication network NW.

The display apparatus 230 displays various types of information image and Graphical User interfaces (GUI) under the control of the control apparatus 210.

The input apparatus 240 receives an input from a user such as a manager, a worker, and the like of the management apparatus 200 (hereinafter referred to as a "management apparatus user"), and outputs the received input to the control apparatus 210. For example, the input apparatus 240 includes an operation input apparatus for receiving an operation input of the management apparatus user. For example, the operation input apparatus may include a touch panel implemented in the display apparatus 230, a keyboard, a mouse, and the like. In addition, for example, the input apparatus 240 may include an audio input apparatus and a gesture input apparatus that receive an audio input and a gesture input, respectively, of the management apparatus user.

The reservation screen display processing unit 211 causes the display apparatus 230 to display an operation screen for receiving the reservation related to the reservation target function of the shovel 100 (i.e., a reservation reception screen) and an operation screen for confirming the received content of the reservation (i.e., a reservation confirmation screen). For example, the reservation screen display processing unit 211 can display a reservation confirmation screen on the basis of the registered reservation information that is periodically uploaded from the shovel 100 or uploaded from the shovel 100 in response to a request from the management apparatus 200 (the control apparatus 210). In a case where the task support system SYS includes multiple shovels 100, a reservation reception screen and a reservation confirmation screen may be displayed for each shovel 100 or for each operator who boards the shovel 100. In this case, before the reservation reception screen and the reservation confirmation screen are displayed on the display apparatus 230, the reservation screen display processing unit 211 displays an operation screen (hereinafter referred to as a "shovel operator selection screen") for selecting the target shovel 100 and the operator (specifically, the shovel 100 boarded by the target operator) from among multiple shovels 100 and multiple operators, respectively, registered in advance.

The reservation reception unit 212 receives the reservation related to the reservation target function of the shovel 100 in accordance with an operation performed by the management apparatus user on the reservation reception screen displayed on the display apparatus 230 with the input apparatus 240. Also, the reservation reception unit 212 receives the reservation related to the reservation target function of the shovel 100 in accordance with a reservation request signal received from the support terminal 300 through the communication apparatus 220. When the reservation reception unit 212 receives a reservation, the reservation reception unit 212 transmits, to the shovel 100, a reservation instruction signal including the received content of the reservation (for example, the reservation target function, the execution condition, and the like) through the communication apparatus 220. Accordingly, the content of the reservation (the reservation information 304A) is registered in the shovel 100 to which it is transmitted. Specifically, from the outside of the shovel 100, the managing user such as a manager of the management apparatus 200 can make a reservation to execute the reservation target function of the shovel 100.

<Configuration of Support Terminal>

The support terminal 300 includes a control apparatus 310, a communication apparatus 320, a display apparatus 330, and an input apparatus 340.

The control apparatus 310 performs various types of controls related to the support terminal 300. For example, the control apparatus 310 includes, as functional units achieved by causing the CPU to execute the one or more programs installed on the auxiliary storage device, a reservation screen display processing unit 311 and a reservation reception unit 312.

The communication apparatus 320 connects to the communication network NW, and communicates with an external apparatus such as the management apparatus 200 and the like through the communication network NW.

The display apparatus 330 displays various types of information images and GUIs under the control of the control apparatus 310.

The input apparatus 340 receives an input from the support terminal user, and outputs the received input to the control apparatus 310. For example, the input apparatus 340 may include an operation input apparatus for receiving an operation input of the support terminal user. For example, the operation input apparatus may be a touch panel implemented in the display apparatus 330. For example, the input apparatus 340 may include an audio input apparatus and a gesture input apparatus that receive an audio input and a gesture input, respectively, of the support terminal user.

The reservation screen display processing unit 311 causes the display apparatus 330 to display an operation screen for receiving the reservation related to the reservation target function of the shovel 100 (i.e., a reservation reception screen) and an operation screen for confirming the received content of the reservation (i.e., a reservation confirmation screen). The reservation screen display processing unit 311 can display a reservation confirmation screen on the basis of the registered reservation information that is periodically downloaded from the management apparatus 200 or downloaded from the management apparatus 200 on the basis of a request from the support terminal 300 (the control apparatus 310). In a case where the task support system SYS includes multiple shovels 100, a reservation reception screen and a reservation confirmation screen may be displayed for each shovel 100 or for each operator who boards the shovel 100, in a manner similar to the case of the management apparatus 200 (reservation screen display processing unit 211). In this case, before the reservation reception screen and the reservation confirmation screen are displayed on the display apparatus 330, the reservation screen display processing unit 311 may display a shovel operator selection screen.

The reservation reception unit 312 receives the reservation related to the reservation target function of the shovel 100 in accordance with an operation performed by the user on the reservation reception screen displayed on the display apparatus 330 with the input apparatus 340. When the reservation reception unit 312 receives a reservation, the reservation reception unit 312 transmits, to the management apparatus 200, a reservation request signal including the received content of the reservation (for example, the target function, the execution condition, and the like) through the communication apparatus 320. Accordingly, the reservation instruction signal corresponding to the reservation request signal is transmitted to the shovel 100 via the management apparatus 200. The content of the reservation (the reservation information 304A) is registered in the shovel 100 to which it is transmitted. Specifically, from the outside of the shovel 100, the user of the support terminal 300 can make a reservation to execute the reservation target function of the shovel 100.

[Details of Reservation Function of Shovel]

Next, the details of the reservation function of the shovel 100 are explained with reference to FIG. 3 to FIG. 7.

First Example (Engine Warm-Up Reservation Function) of Reservation Function

First, the reservation function related to execution of the engine warm-up function of the shovel 100 (hereinafter referred to as an "engine warm-up reservation function") is explained with reference to FIG. 3.

Figure 3:
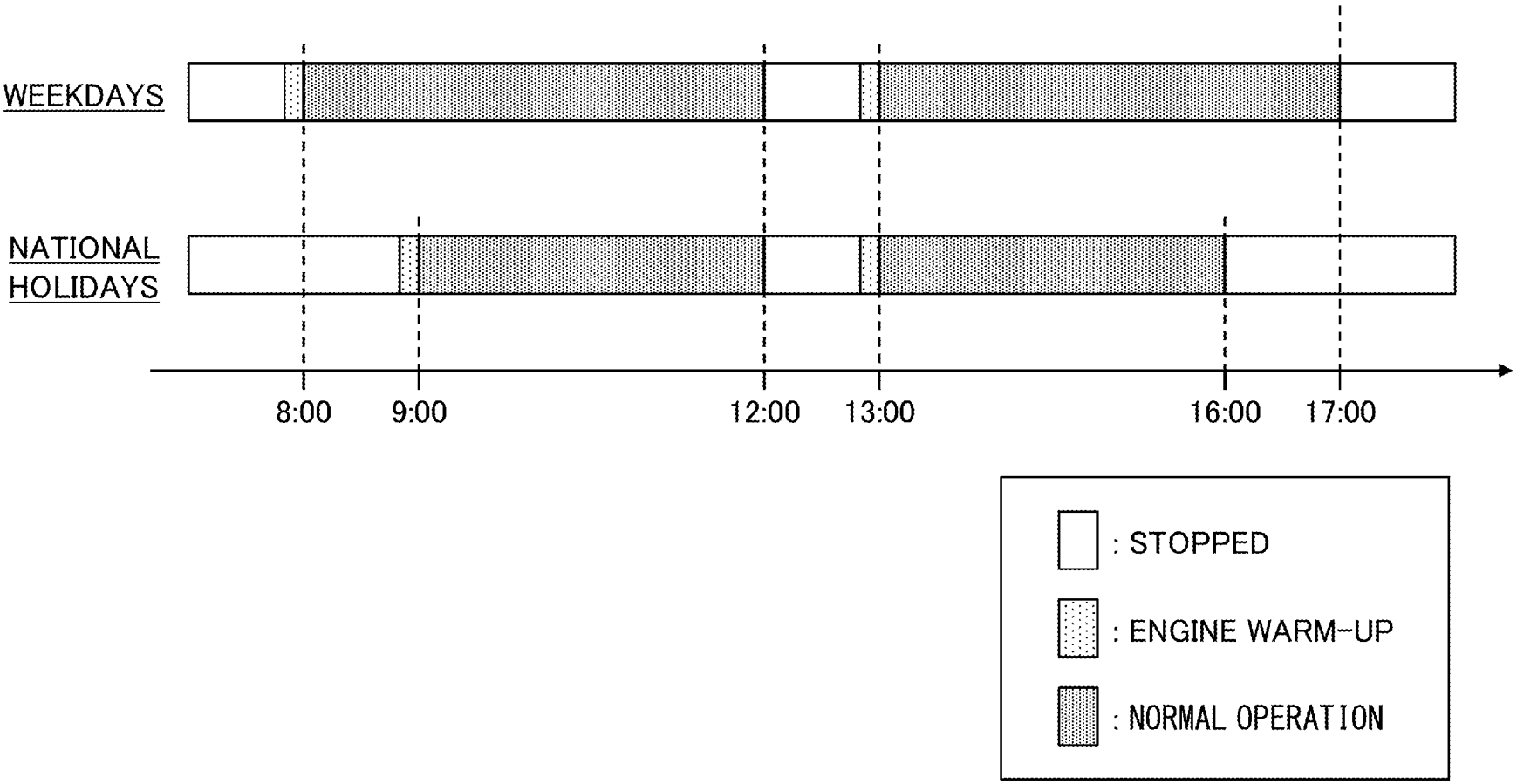
FIG. 3 is a drawing for explaining a first example (an engine warm-up reservation function) of a reservation function.

FIG. 3 is a drawing for explaining a first example (an engine warm-up reservation function) of the reservation function of the shovel 100. Specifically, FIG. 3 illustrates a drawing illustrating the movement state of the shovel 100 (as to whether the movement state is "stopped", "engine warm-up", or "normal operation") and an execution condition (a date-and-time condition) of the engine warm-up reservation function on both of weekdays (i.e., Monday to Friday except national holidays) and national holidays (i.e., national holidays on Monday to Friday).

In this example, on weekdays, the shovel 100 automatically starts to perform the engine warm-up at 7:50, i.e., 10 minutes before 8:00, which is the start time of the work in the work site in the morning, under the control of the controller 30 (the reservation execution unit 305 and the reservation target functional unit 301). On weekdays, the shovel 100 automatically starts to perform the engine warm-up at 12:50, i.e., 10 minutes before 13:00, which is the start time of the work in the work site in the afternoon, under the control of the controller 30. On national holidays, the shovel 100 automatically starts to perform the engine warm-up at 8:50, i.e., 10 minutes before 9:00, which is the start time of the work in the work site in the morning, under the control of the controller 30. On national holidays, the shovel 100 automatically starts to perform the engine warm-up at 12:50, i.e., 10 minutes before 13:00, which is the start time of the work in the work site in the afternoon, under the control of the controller 30.

In this example, the execution condition of the engine warm-up reservation function may be defined by temporal conditions including a condition of days of week (Monday to Friday), a condition as to national holiday, and a condition of a start time of the shovel 100 (7:50, 8:50, or 12:50). Instead of the condition of the start time of the shovel 100, a condition of a start time of the work (8:00, 9:00, or 13:00) and a condition of a duration of the engine warm-up (10 minutes) may be employed. For example, the execution condition of the engine warm-up reservation function may include an environment condition indicating that, e.g., "the outdoor temperature is equal to or less than a predetermined temperature". In this case, the outdoor temperature of the shovel 100 may be obtained by an outdoor temperature sensor provided in the shovel 100 (for example, the upper turning body 3).

The duration of the engine warm-up may be determined as appropriate in accordance with the technical specification, season, and the like of the shovel 100.

When the execution condition designated by the reservation information 304A (the date-and-time condition) is satisfied, the reservation execution unit 305 starts the reservation target functional unit 301 (the engine warm-up functional unit). Then, the reservation target functional unit 301 (the engine warm-up functional unit) automatically transitions the key switch of the shovel 100 from OFF to ON to automatically start the shovel 100, and also maintains the rotational speed of the engine 11 at an idle speed to perform the engine warm-up of the shovel 100.

The shovel user such as the operator of the shovel 100 and the manager in the work site confirms the reservation content by designating the execution condition on the reservation reception screen of the display apparatus 50 with the input apparatus 52. Accordingly, the shovel user such as the operator of the shovel 100 and the manager in the work site can cause the shovel 100 to automatically start and perform the engine warm-up in accordance with the temporal condition, without going to the shovel 100 and performing an operation to turn ON the key switch. The management apparatus user and the support terminal user such as the manager and the like of the management apparatus 200 confirms the reservation content by designating the execution condition on the reservation reception screen displayed on the display apparatus 230, 330 with the input apparatus 240, 340. Accordingly, the management apparatus user and the support terminal user such as the manager and the like of the management apparatus 200 can cause the shovel 100 to automatically start and perform the engine warm-up in accordance with the temporal condition, without sending someone to the shovel 100 and perform an operation to turn ON the key switch. Therefore, it is not necessary to previously have someone board the shovel 100 and perform an operation to turn ON the key switch before the start of the work, and the convenience for the operator of the shovel 100 the manager in the work site, and the like can be improved. Furthermore, even without performing an operation to turn ON the key switch of the shovel 100, the engine warm-up of the shovel 100 is completed before the start of the work, the task of using the shovel 100 can be started immediately, so that the work efficiency of the shovel 100 can be improved. Still furthermore, at the start of the work in the work site, the manager in the work site, the manager of the management apparatus 200, and the like do not have to individually ascertain the execution situation of start and engine warm-up of the shovel 100, so that the efficiency related to operation of the shovel 100 can be improved.

Second Example (Automatic Task Reservation Function) of Reservation Function Next, the reservation function related to execution of the automatic task function of the shovel 100 (hereinafter referred to as an "automatic task reservation function") is explained with reference to FIG. 4.

Figure 4:
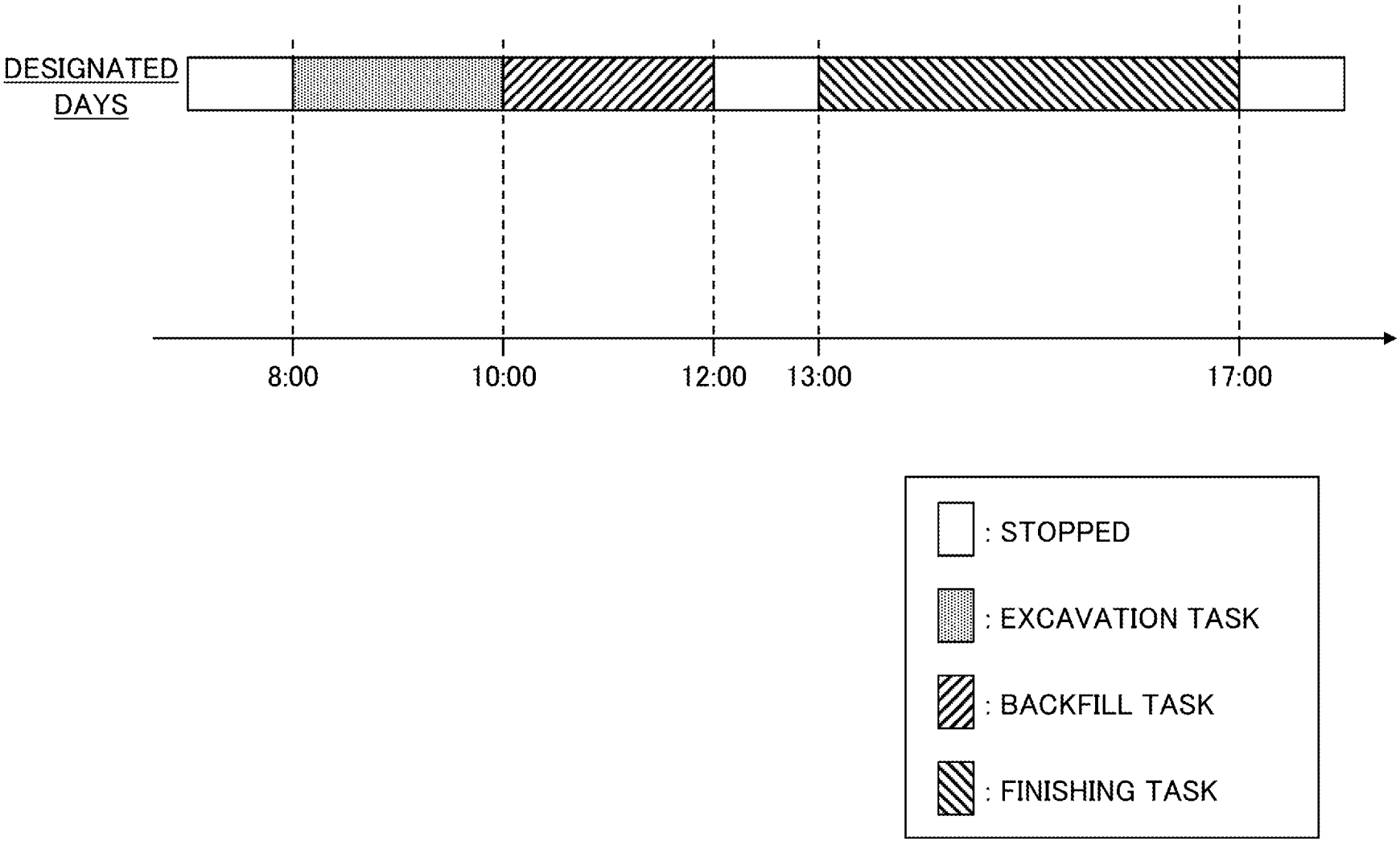
FIG. 4 is a drawing for explaining a second example (an automatic task reservation function) of the reservation function.

FIG. 4 is a drawing for explaining the second example of the reservation function of the shovel 100 (the automatic task reservation function). Specifically, FIG. 4 is a drawing illustrating the work schedule of the shovel 100 on a designated day (a designated day, multiple designated days, or a day in a duration) and the execution condition (the date-and-time condition) of the automatic task reservation function.

In this example, on the designated day, the shovel 100 automatically performs an excavation task in a predetermined work area for two hours from 8:00 to 10:00 which is the start time of the work of the work site, under the control of the controller 30 (the reservation execution unit 305 and the reservation target functional unit 301). In this case, when the shovel 100 is in the OFF state at 8:00, the shovel 100 may automatically start under the control of the controller 30. Hereinafter, this is also applicable to the case where the shovel 100 is in the OFF state at 13:00. Also, the shovel 100 automatically performs a backfill task in the same work area under the control of the controller 30 for two hours from 10:00 to 12:00. In this case, the backfill task may include a task for burying a predetermined object. Also the shovel 100 performs a finishing task (a task for flattening the work area that has been backfilled by compaction and the like, so that the work area returns back to a flat state prior to the excavation) in the same work area in 4 hours from 13:00 to 17:00 under the control of the controller 30. In this case, the shovel 100 may be automatically caused to stop at 17:00 under the control of the controller 30. Before the shovel 100 is automatically stopped, the shovel 100 may move to a predetermined location (for example, the above-described parking location) under the control of the controller 30 (the reservation execution unit 305). Also, before the shovel 100 is automatically stopped, the shovel 100 may give a notification to prompt the user to a predetermined location (for example, the above-described parking location) through predetermined notification means (for example, the display apparatus 50, a speaker in the cab 10, and the like).

In this example, the execution condition of the automatic task reservation function may be defined by temporal conditions including a condition of a date, a condition of a start time (8:00, 10:00, or 13:00), and a condition of an end time (10:00, 13:00, or 17:00) for each of the target automatic tasks (the excavation task, the backfill task, and the finishing task). Instead of the condition of the end time, a length of time of the task (2 hours or 4 hours) since the start time may be employed. Alternatively, a subsequent automatic task may be configured to be started when a previous automatic task ends. In this case, the execution condition of the automatic task reservation function may include an operation situation condition (for example, "the shovel 100 has finished an excavation task for foaming a previously defined excavation target surface (a groove, a hole, or the like) and has stopped the excavation task" and the like) and an environment condition (for example, "the previously defined excavation target surface has been formed in the work area around the shovel 100" and the like), instead of or in addition to the date-and-time condition. In a case where the automatic task is not finished even when the end time comes, the automatic task may be continued until the automatic task is finished. In this case, the execution condition for the automatic task reservation function, i.e., the execution condition for continuing the automatic task may include an AND condition of the date-and-time condition and the operation situation condition (for example, "the scheduled task has not been finished even when the end scheduled time comes").

When, for multiple target tasks, the execution condition designated by the reservation information 304A (the date-and-time condition) is satisfied, the reservation execution unit 305 starts the reservation target functional unit 301 (the automatic task functional unit). Then, in accordance with an instruction from the reservation execution unit 305, the reservation target functional unit 301 (the automatic task functional unit) controls the proportional valve 31, and causes the shovel 100 to automatically execute the target task related to the predetermined work area.

The shovel user such as the operator of the shovel 100 and the manager in the work site confirms the reservation content by designating the execution condition for each of the multiple tasks on the reservation reception screen of the display apparatus 50 with the input apparatus 52. Accordingly, the shovel user such as the operator of the shovel 100 and the manager in the work site can cause the shovel 100 to automatically perform multiple tasks in order, without going to the shovel 100 and performing a start operation of the automatic task. Also, the management apparatus user and the support terminal user such as the manager and the like of the management apparatus 200 confirms the reservation content by designating the execution condition on the reservation reception screen displayed on the display apparatus 230, 330 with the input apparatus 240, 340. Accordingly, the management apparatus user and the support terminal user such as the manager and the like of the management apparatus 200 can cause the shovel 100 to automatically perform multiple tasks in order, without having someone in the work site board the shovel 100 to perform a start operation of the automatic task. It is not necessary to have someone board the shovel 100 to perform a start operation of the automatic task at the start of the work for each of the target tasks, and the convenience of the operator of the shovel 100, the manager in the work site, and the like can be improved. In addition, the waiting time between any given task and a subsequent task can be eliminated, and therefore, the work efficiency of the shovel 100 can be improved. Furthermore, the manager in the work site, the manager of the management apparatus 200, and the like do not have to individually ascertain the situation of the automatic task of the shovel 100, and the efficiency related to operation of the shovel 100 can be improved.

Third Example (Self-Diagnosis Reservation Function) of Reservation Function

Next, the reservation function related to execution of the function of self-diagnosis of the shovel 100 (hereinafter referred to as a "self-diagnosis reservation function") is explained with reference to FIG. 5.

Figure 5:
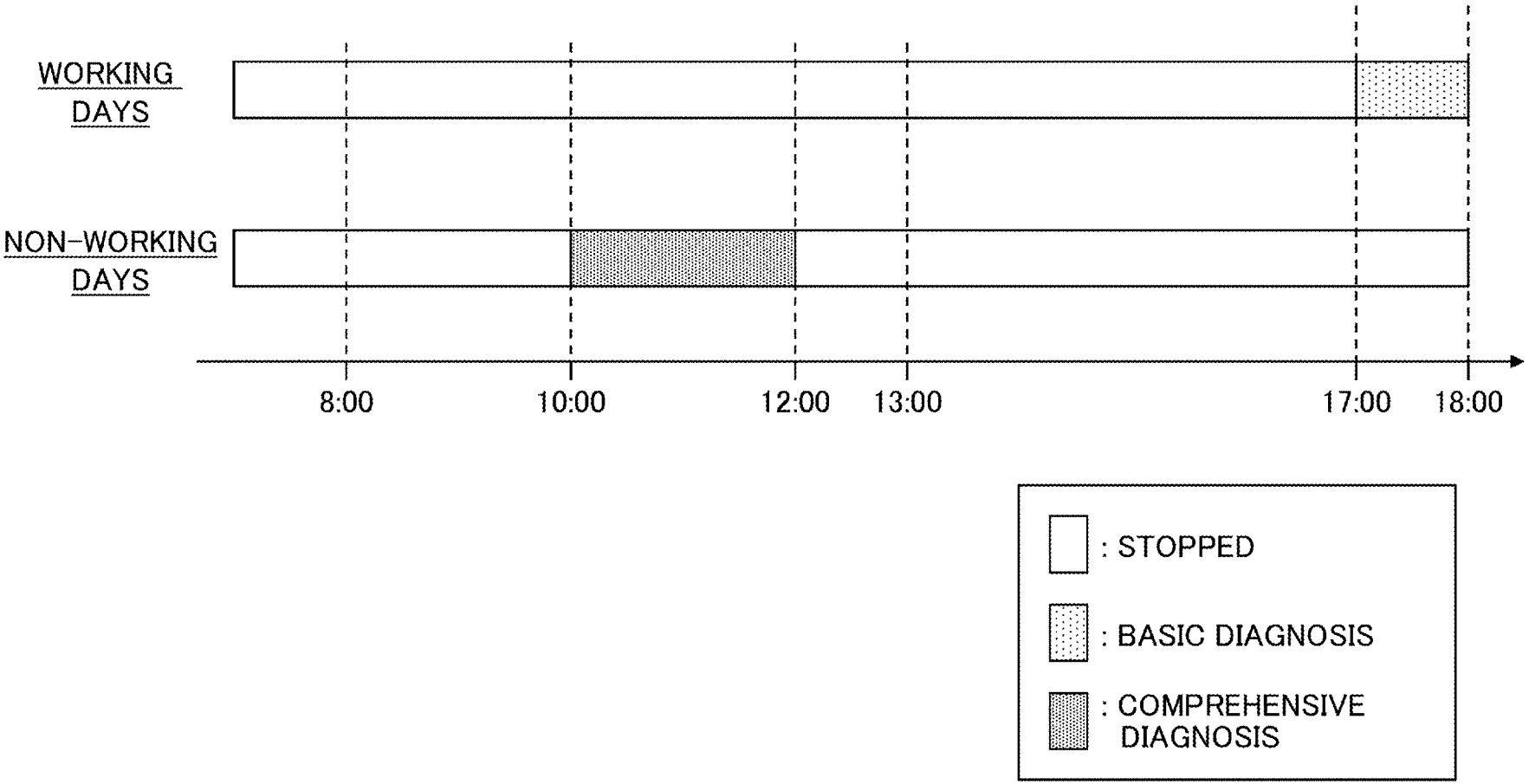
FIG. 5 is a drawing for explaining a third example (a self-diagnosis reservation function) of the reservation function.

FIG. 5 is a drawing for explaining a third example of the reservation function of the shovel 100 (a self-diagnosis reservation function). Specifically, FIG. 5 is a drawing illustrating the operating state of the function of self-diagnosis (whether the function of self-diagnosis is "stopped", "basic diagnosis", or "comprehensive diagnosis") and the execution condition of the self-diagnosis reservation function of both of the working day (for example, Monday to Friday) and non-working day (for example, Saturday and Sunday) of the shovel 100.

In this example, on working days, the shovel 100 performs a basic self-diagnosis for one hour from 17:00 to 18:00 which is the end time of the work of the work site (hereinafter referred to as a "basic diagnosis") under the control of the controller 30 (the reservation execution unit 305 and the reservation target functional unit 301). For example, the basic diagnosis may be a self-diagnosis performed with respect to some of the major items of multiple diagnosis items, a self-diagnosis performed with respect to some of the major devices of multiple devices, or a self-diagnosis that supports them both. On non-working days, the shovel 100 performs a total self-diagnosis from 10:00 to 12:00 (hereinafter referred to as a "comprehensive diagnosis") under the control of the controller 30. For example, the comprehensive diagnosis is a self-diagnosis with respect to all of the multiple target devices and all of the multiple diagnosis items.

The required time (one hour or two hours) of the self-diagnosis (the basic diagnosis or the comprehensive diagnosis) is merely an approximate time, and may be shorter or longer depending on cases.

In this example, the execution condition of the self-diagnosis reservation function may be defined by temporal conditions including a condition of days of week (Monday to Friday or Saturday and Sunday) and a condition of a start time of the function of self-diagnosis. In a case where self-diagnosis (basic diagnosis) is performed after the end of the work on working days, the execution condition of the self-diagnosis reservation function may include an operation situation condition (for example, "the key switch of the shovel 100 is switched from ON to OFF, and as a result, the shovel 100 has stopped" and the like), instead of or in addition to the temporal condition.

When the execution condition designated by the reservation information 304A (the temporal condition) is satisfied, the reservation execution unit 305 starts the reservation target functional unit 301 (the function of self-diagnosis unit). Then, the reservation target functional unit 301 (the automatic task functional unit) performs a self-diagnosis (the basic diagnosis or the comprehensive diagnosis) of the type that is designated by an instruction from the reservation execution unit 305.

The shovel user such as the operator of the shovel 100 and the manager in the work site confirms the reservation content by designating the execution condition on the reservation reception screen of the display apparatus 50 with the input apparatus 52. Accordingly, the shovel user such as the operator of the shovel 100 and the manager in the work site can cause the self-diagnosis of the shovel 100 to be performed in a period of time in which the key switch of the shovel 100 is turned OFF and the shovel 100 does not perform any task. Also, the management apparatus user and the support terminal user such as the manager and the like of the management apparatus 200 confirms the reservation content by designating the execution condition on the reservation reception screen displayed on the display apparatus 230, 330 with the input apparatus 240, 340. Accordingly, the management apparatus user and the support terminal user such as the manager and the like of the management apparatus 200 can cause the self-diagnosis of the shovel 100 to be performed in a time period in which the shovel 100 does not perform any task, without having someone in the work site board the shovel 100 to perform setting operation related to function of self-diagnosis. Therefore, early detection of abnormality, malfunction, and the like owing to periodical execution of the function of self-diagnosis can be achieved, and the function of self-diagnosis is not executed during the task of the shovel 100, so that the processing efficiency of the controller 30 does not decrease. In other words, the safety due to early detection of abnormality, malfunction, and the like of the shovel 100 can be secured, and also, the workability of the shovel 100 can be secured. The manager in the work site and the manager and the like of the management apparatus 200 do not have to individually ascertain the execution situation of the self-diagnosis of the shovel 100, and the efficiency related to operation of the shovel 100 can be improved.

Fourth Example of Reservation Function
(Operation Restriction Reservation Function)

Figure 6A:
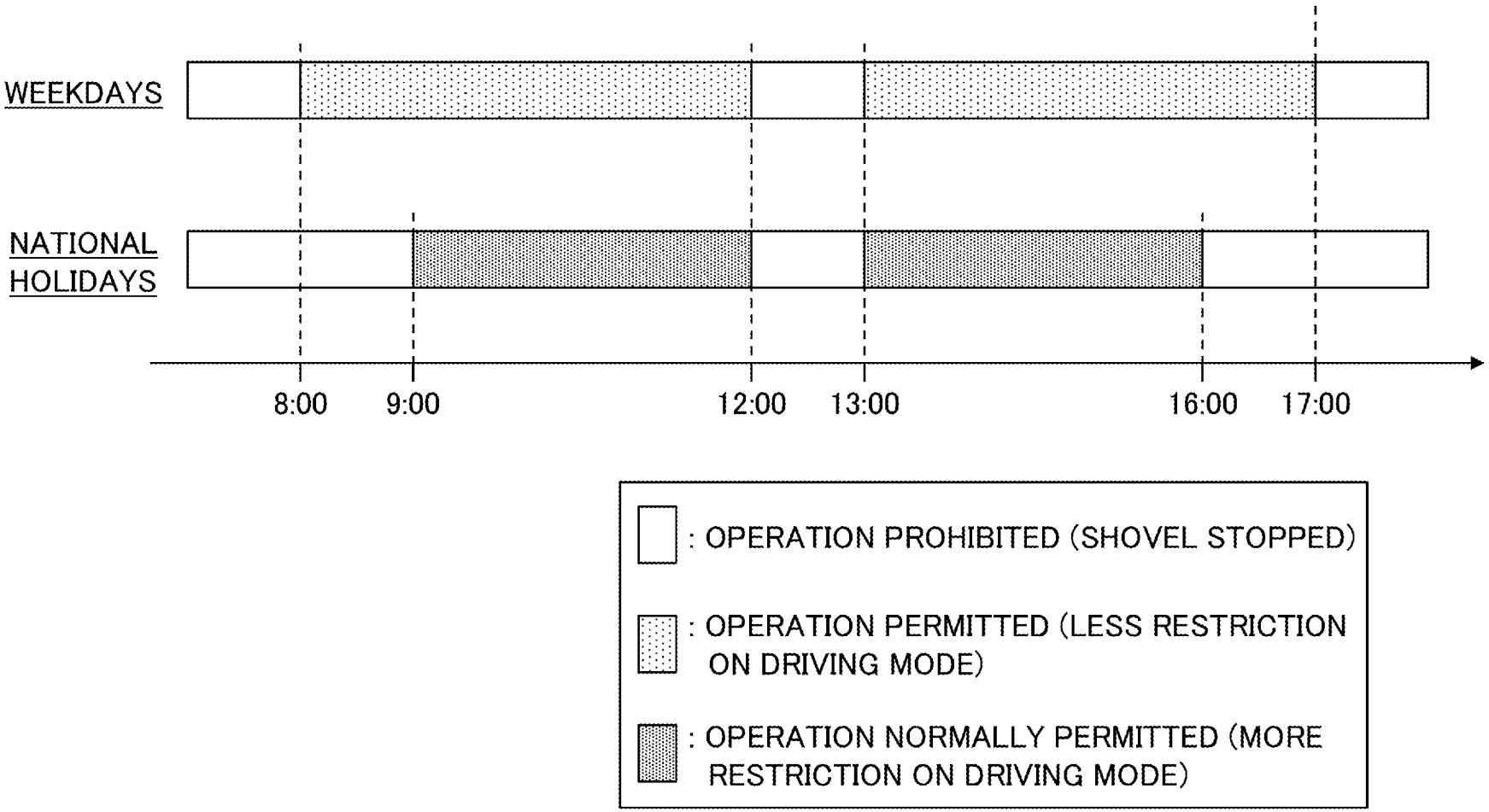
FIG. 6A is a drawing for explaining a fourth example (an operation restriction reservation function) of the reservation function.
Figure 6B:
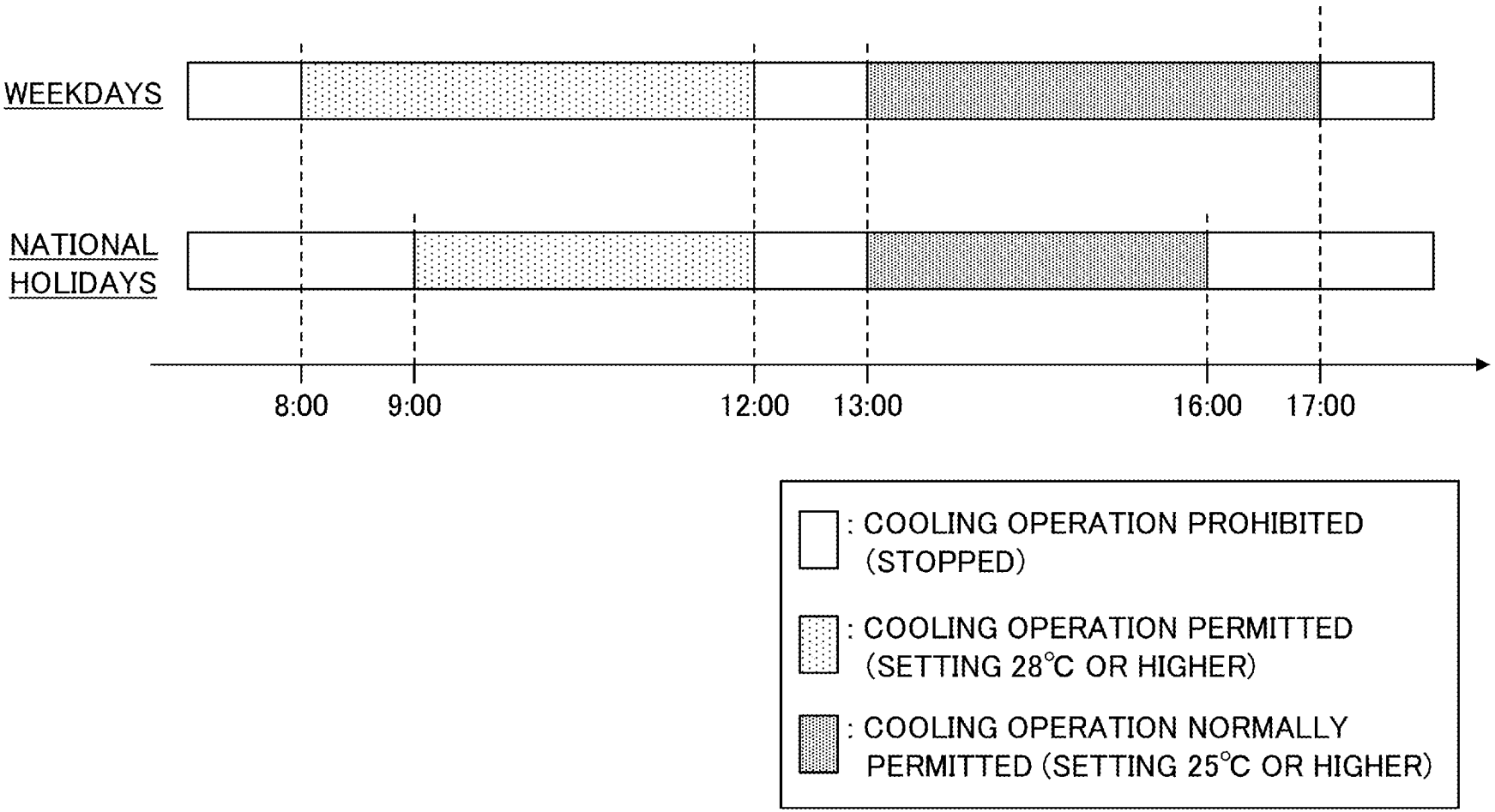
FIG. 6B is a drawing for explaining a fourth example (an operation restriction reservation function) of the reservation function.

Next, the reservation function of the operation restriction function of the shovel 100 (hereinafter referred to as an "operation restriction reservation function") is explained with reference to FIG. 6 (FIG. 6A, FIG. 6B). Specifically, the reservation function related to execution of the operation time restriction function of the shovel 100 (hereinafter referred to as an "operation time restriction reservation function"), the reservation function related to execution of the output restriction function (hereinafter referred to as an "output restriction reservation function"), and the reservation function related to execution of the air conditioning restriction function (hereinafter referred to as an "air conditioning restriction reservation function") are explained.

FIG. 6A and FIG. 6B are drawings for explaining a fourth example of the reservation function of the shovel 100 (an operation restriction reservation function). Specifically, FIG. 6A is a drawing illustrating execution conditions of the operation time restriction reservation function and the output restriction reservation function of the shovel 100 (the date-and-time condition) on both of weekdays (specifically, Monday to Friday other than national holidays) and national holidays (specifically, national holidays on Monday to Friday). FIG. 6B is a drawing illustrating execution conditions of the air conditioning restriction reservation function of the shovel 100 (the date-and-time condition) on both of weekdays (specifically, Monday to Friday other than national holidays) and national holidays (specifically, national holidays on Monday to Friday).

As illustrated in FIG. 6A, in this example, on weekdays, the shovel 100 restricts the operation-permitted time period of the shovel 100 to 8:00 to 12:00 and 13:00 to 17:00, under the control of the controller 30 (the reservation execution unit 305 and the reservation target functional unit 301). In other words, the shovel 100 prevents the shovel 100 from starting (i.e., the ON state of the key switch) in the time periods, i.e., before 8:00, 12:00 to 13:00, and after 17:00, under the control of the controller 30. On national holidays, the shovel 100 restricts the operation-permitted time period of the shovel 100 to 9:00 to 12:00 and 13:00 to 16:00, under the control of the controller 30. In other words, the shovel 100, under the control of the controller 30, prevents the shovel 100 from starting (i.e., the ON state of the key switch) in the time periods, i.e., before 9:00, 12:00 to 13:00, and after 16:00.

Also, in the operation-permitted time period (from 8:00 to 12:00 and from 13:00 to 17:00) on weekdays, the shovel 100 restricts the selectable driving modes to some of the driving modes with relatively low outputs so as to relatively reduce the degree of restriction (for example, causes only the second mode and the third mode to be selectable from among the above-described first mode to third mode), under the control of the controller 30. On national holidays, the shovel 100 restricts the selectable driving modes to some of the driving modes with relatively low outputs so as to relatively increase the degree of restriction (for example, causes only the third mode to be selectable from among the above-described first mode to third mode), under the control of the controller 30.

In this example, the execution condition of the operation time restriction reservation function and the output restriction reservation function may be defined by temporal conditions including a condition of days of week (Monday to Friday), a condition as to national holidays, and a condition of a start time (8:00, 9:00, or 13:00) and an end time (12:00, 16:00, or 17:00) of the time period of the operation-permitted time period and the output restriction. The execution condition of the output restriction reservation function may include an operation situation condition (for example, "the load state of the shovel 100 is equal to or less than a predetermined reference"), an environment condition ("for example, "the soil of the terrain of the excavation target around the shovel 100 is relatively soft"), and the like, instead of or in addition to the temporal condition. This is because the work efficiency of the shovel 100 may greatly decrease if the selectable driving modes are restricted under the situation where the load state of the shovel 100 is relatively high (higher than a predetermined reference).

When the reservation execution unit 305 detects that it is out of the operation-permitted time period of the shovel 100 on the basis of the execution condition (the temporal condition) related to the operation time restriction function designated by the reservation information 304A, the reservation execution unit 305 starts the reservation target functional unit 301 (the operation restriction functional unit). Further, in a case where the shovel 100 is not in operation (i.e., not working), for example, the reservation target functional unit 301 (operation restriction functional unit) fixes the key switch to OFF so that the shovel 100 (the shovel in question) cannot be started, and in a case where the shovel 100 is in operation (i.e., working), the reservation target functional unit 301 (operation restriction functional unit) turns off the key switch to forcibly stop the shovel 100. Also, when the execution condition (the temporal condition) related to the output restriction function designated by the reservation information 304A is satisfied, the reservation execution unit 305 starts the reservation target functional unit 301 (the operation restriction functional unit). Then, the reservation target functional unit 301 (the operation restriction functional unit) restricts the selectable driving modes to some of the driving modes with a relatively low output, in accordance with the restriction condition designated by the reservation information 304A, i.e., the condition related to the available driving modes.

The manager at the work site or the like confirms the reservation content by designating the execution condition related to the operation time restriction function and the output restriction function on the reservation reception screen of the display apparatus 50 with the input apparatus 52. Accordingly, without confirming the operating situation of the shovel 100 in the work site by visual check and the like, the manager in the work site or the like can restrict the operating time period of the shovel 100, the selectable driving modes that are selectable in the operating time period, and the like, in accordance with the execution condition. In addition, the management apparatus user and the support terminal user such as the manager and the like of the management apparatus 200 confirm the reservation content by designating the execution condition on the reservation reception screen displayed on the display apparatus 230, 330 with the input apparatus 240, 340. Accordingly, the management apparatus user and the support terminal user such as the manager and the like of the management apparatus 200 (for example, the manager in the work site and the like) can restrict the operating time period of the shovel 100 and the selectable driving mode in accordance with the execution condition, without having someone in the work site confirm the operating situation of the shovel 100. Therefore, the manager in the work site, the manager of the management apparatus 200, and the like can strictly manage the operating time period of the shovel 100 in the work site, and can also inhibit the use in a driving mode with an unnecessarily high output. Therefore, the noise in the work site in the early morning and the late evening can be inhibited, and the fuel consumption (the energy efficiency) of the shovel 100 can be improved. In addition, the manager in the work site, the manager of the management apparatus 200, and the like do not have to individually ascertain the operating situation of the shovel 100, and the efficiency related to operation of the shovel 100 can be improved.

Furthermore, as illustrated in FIG. 6B, in this example, on (summer) weekdays (specifically, Monday to Friday except national holidays), the shovel 100 prevents the air conditioning apparatus (the cooling operation) in the cab 10 from being used, under the control of the controller 30 (the reservation execution unit 305 and the reservation target functional unit 301). In other words, before 8:00, 12:00 to 13:00, and after 17:00, the shovel 100, under the control of the controller 30, does not allow the air conditioning apparatus to start even if an operation unit for starting the cooling operation of the air conditioning apparatus is operated to turn ON the air conditioner. In addition, on (summer) weekdays, the shovel 100 restricts the temperature setting of the air conditioning apparatus in the cab 10 to 28° C. or more for 4 hours from 8:00 to 12:00, and restricts the temperature setting of the air conditioning apparatus in the cab 10 to 25° C. or more for 4 hours from 13:00 to 17:00, under the control of the controller 30. In other words, the shovel 100 restricts the temperature setting of the air conditioning apparatus in the cab 10 so that the temperature setting cannot be set to less than 25° C. for 4 hours from 8:00 to 12:00, and restricts the temperature setting of the air conditioning apparatus in the cab 10 so that the temperature setting cannot be set to less than 25° C. for 4 hours from 13:00 to 17:00, under the control of the controller 30. On (summer) national holiday (specifically, national holidays on Monday to Friday), the shovel 100 prevents the air conditioning apparatus (cooling operation) in the cab 10 from being used before 9:00, 12:00 to 13:00, and after 16:00, under the control of the controller 30. On (summer) national holidays, the shovel 100 restricts the temperature setting of the air conditioning apparatus in the cab 10 to 28° C. or more for 3 hours from 9:00 to 12:00, and restricts the temperature setting of the air conditioning apparatus in the cab 10 to 25° C. or more for 3 hours from 13:00 to 16:00, under the control of the controller 30.

In this example, the execution condition of the air conditioning restriction reservation function may be defined by temporal conditions including a condition of dates corresponding to the summer season, a condition of days of week (Monday to Friday), a condition as to national holiday, and a condition of a start time (8:00, 9:00, or 13:00) and an end time (12:00, 16:00, or 17:00) of the cooling operation-permitted time period or the temperature setting-restricted time period. The execution condition of the air conditioning restriction reservation function may include an environment condition (for example, "the outdoor temperature is equal to or more than a predetermined first temperature and equal to or less than a second temperature" and the like) instead of or in addition to the temporal condition. This is because the temperature setting of the air conditioning apparatus is considered to be unnecessarily lowered by the operator in a situation where the outdoor temperature such as during summer is relatively high (i.e., a situation where the outdoor temperature is equal to or more than a first temperature). This is also because in a situation where the outdoor temperature is too high (i.e., a situation where the outdoor temperature exceeds a second temperature), the health of the operator in the cab 10 should be prioritized over the reduction of the fuel consumption of the shovel 100.

When the reservation execution unit 305 detects that it is out of the cooling operation-permitted time period on the basis of the execution condition related to the air conditioning restriction reservation function designated by the reservation information 304A, the reservation execution unit 305 starts the reservation target functional unit 301 (the operation restriction functional unit). Then, in a case where the air conditioning apparatus is not performing the cooling operation, the reservation target functional unit 301 (operation restriction functional unit) maintains the invalidation of the operation related to the cooling operation of the air conditioning apparatus, and in a case where the air conditioning apparatus is performing the cooling operation, the reservation target functional unit 301 (operation restriction functional unit) forcibly stops the operation related to the cooling operation of the air conditioning apparatus. In a case where the execution condition related to restriction of the temperature setting of the cooling operation restriction function is satisfied, the reservation execution unit 305 starts the reservation target functional unit 301 (the operation restriction functional unit). Then, the reservation target functional unit 301 (the operation restriction functional unit) maintains the invalidation of the setting operation for deviating from the restriction condition (for example, 25° C. or more or 28° C. or more) related to the temperature setting designated by the reservation information 304A.

The manager in the work site and the like confirms the reservation content by designating the execution condition related to the air conditioning restriction reservation function on the reservation reception screen of the display apparatus 50 with the input apparatus 52. Accordingly, without confirming the use situation of the air conditioning apparatus of the shovel 100 in the work site by visual check and the like, the manager and the like in the work site can restrict the use time period of the air conditioning apparatus, the temperature setting for the use time period, and the like, in accordance with the execution condition. The management apparatus user and the support terminal user such as the manager and the like of the management apparatus 200 confirms the reservation content by designating the execution condition on the reservation reception screen displayed on the display apparatus 230, 330 with the input apparatus 240, 340. Accordingly, without having someone in the work site confirm the use situation of the air conditioning apparatus of the shovel 100, the management apparatus user and the support terminal user such as the manager and the like of the management apparatus 200 (for example, the manager and the like in the work site) can restrict the use time period of the air conditioning apparatus of the shovel 100, the temperature setting in that use time period, and the like, in accordance with the execution condition. Therefore, the manager in the work site, the manager of the management apparatus 200, and the like can inhibit the air conditioning apparatus of the shovel 100 in the work site from being unnecessarily used other than in the work time period of the work site and from being used with an unnecessarily low temperature setting. Therefore, the fuel consumption (the energy efficiency) of the shovel 100 can be improved. The manager in the work site, the manager of the management apparatus 200, and the like do not have to individually ascertain the use situation of the air conditioning apparatus of the shovel 100, and the efficiency related to operation of the shovel 100 can be improved.

Fifth Example (Reservation Function Related to Execution of Multiple Reservation Target Functions) of Reservation Function Next, the reservation function of the shovel 100 related to execution of multiple reservation target functions is explained with reference to FIG. 7.

FIG. 7 is a drawing for explaining a fifth example of the reservation function of the shovel 100. Specifically, FIG. 7 is a drawing illustrating an overview of execution conditions of the reservation function of the shovel 100 related to execution of multiple reservation target functions.

In this example, the shovel 100 includes the reservation function related to execution of multiple reservation target functions. Specifically, the shovel 100 includes the reservation function related to the execution of the reservation target function according to the first example to fourth example described above (the engine warm-up reservation function, the automatic task reservation function, the self-diagnosis reservation function, the operation time restriction reservation function, the output restriction reservation function, and the air conditioning restriction reservation function).

As illustrated in FIG. 7, in the shovel 100, the execution condition is defined for each type of reservation function.

For example, as described above, the execution condition of the engine warm-up reservation function may be defined by temporal conditions including a condition of days of week and a condition of the start time of the shovel 100. For example, as described above, the execution condition of the engine warm-up reservation function may be defined by an environment condition including a condition related to temperature in addition to the temporal condition.

In addition, for example, as described above, the execution condition of the automatic task reservation function may be defined by a temporal condition for each target automatic task. Also, as described above, depending on the relationship of the order of the contents of the target automatic task and another automatic task, the execution condition of the automatic task reservation function may be defined by the operation situation condition of the shovel 100 instead of or in addition to the temporal condition.

In addition, for example, as described above, the execution condition of the self-diagnosis reservation function may be defined by temporal conditions including a condition of days of week and a condition of a start time of function of self-diagnosis. Also, as described above, depending on the content of self-diagnosis, the execution condition of the self-diagnosis reservation function may be defined by the operation situation condition of the shovel 100 instead of or in addition to the temporal condition.

In addition, for example, as described above, the execution condition of the operation time restriction reservation function may be defined by a temporal condition.

In addition, for example, as described above, the execution condition of the output restriction reservation function may be defined by temporal conditions. Also, as described above, the execution condition of the output restriction reservation function may be defined by an operation situation condition and an environment condition, instead of or in addition to the temporal conditions.

In addition, for example, as described above, the execution condition of the air conditioning restriction reservation function may be defined by a temporal condition. In addition, as described above, the execution condition of the air conditioning restriction reservation function may be defined by, for example, an environment condition including a temperature, instead of or in addition to the temporal conditions.

In this example, the shovel user can set a predetermined execution condition in the controller 30 for each type of reservation function by performing a predetermined input with the input apparatus 52. Likewise, the management apparatus user and the support terminal user can set a predetermined execution condition in the control apparatus 210, 310 for each type of reservation function by performing a predetermined input with the input apparatus 240, 340. Therefore, the shovel 100 can automatically execute multiple different reservation target functions in accordance with a user's request.

Specific Example of Reservation Screen

Figure 8A:
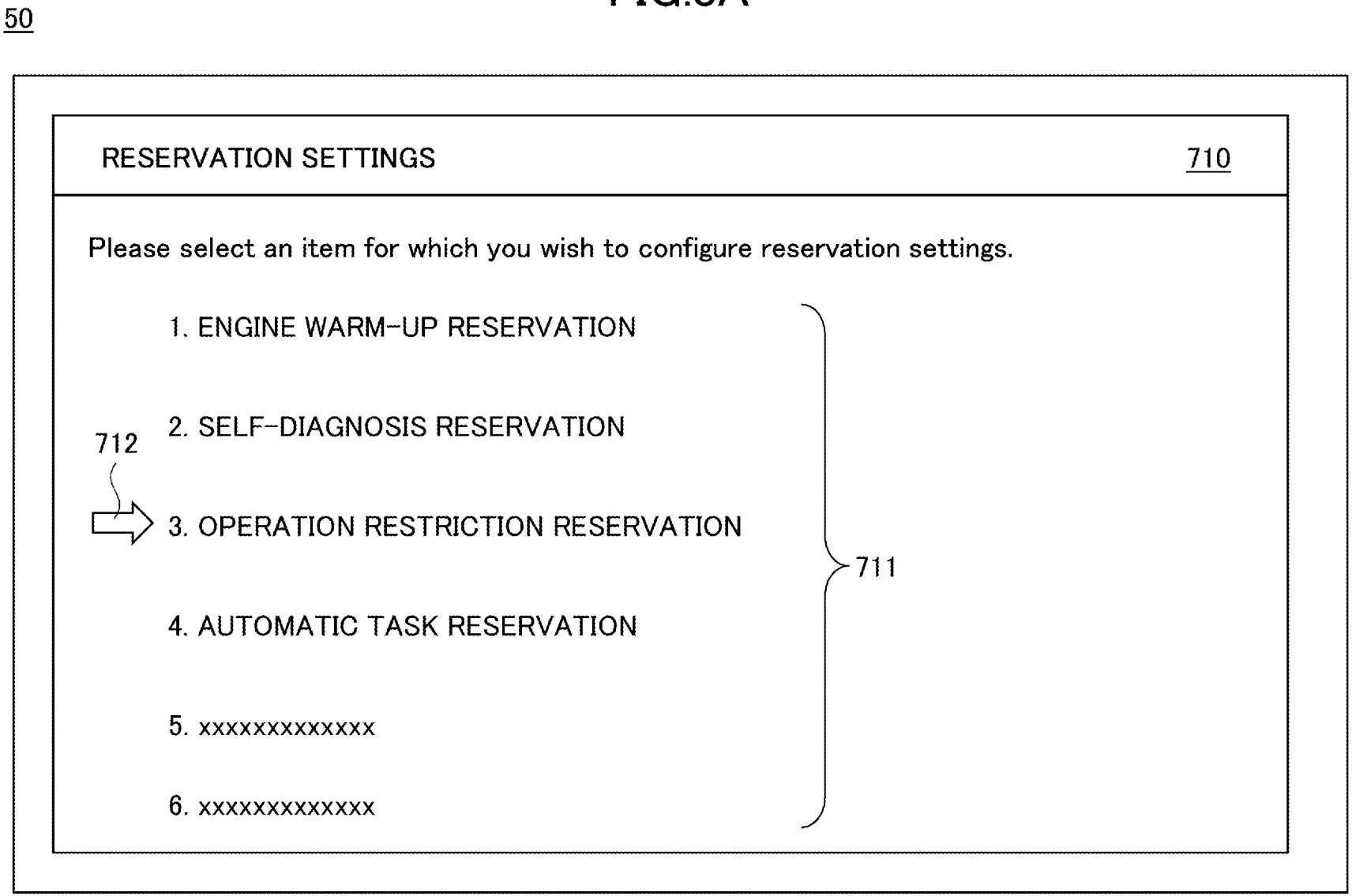
FIG. 8A is a drawing illustrating a specific example of a reservation screen.
Figure 8B:
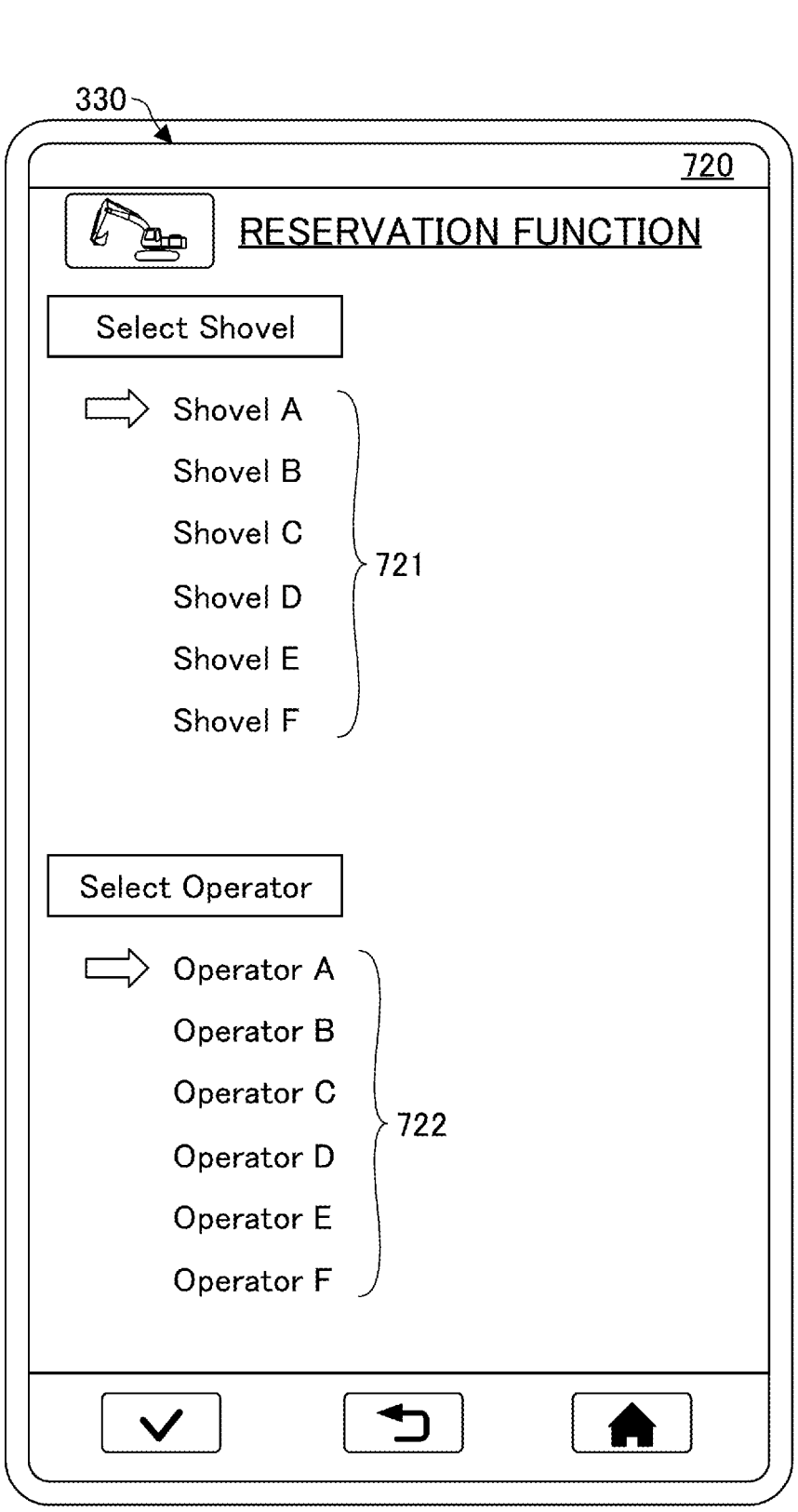
FIG. 8B is a drawing illustrating a specific example of a reservation screen.

Next, specific examples of reservation screens displayed on the display apparatus 50 of the shovel 100, the display apparatus 230 of the management apparatus 200, or the display apparatus 330 of the support terminal 300 is explained with reference to FIG. 8 (FIG. 8A, FIG. 8B)

FIG. 8A and FIG. 8B are drawings for explaining specific examples of reservation screens displayed on the display apparatus 50, 230, 330. Specifically, FIG. 8A is a drawing illustrating an example of a reservation reception screen displayed on the display apparatus 50 of the shovel 100. More specifically, FIG. 8A is a drawing illustrating an example of (a reservation target function selection screen 710) of a reservation reception screen (hereinafter referred to as a "reservation target function selection screen") for selecting the reservation target function displayed on the display apparatus 50. FIG. 8B is a drawing illustrating an example of (a shovel operator selection screen 720) of a shovel operator selection screen displayed on the display apparatus 330 of the support terminal 300.

A screen similar to the reservation target function selection screen 710 of FIG. 8A may be displayed on the display apparatus 230 of the management apparatus 200 or the display apparatus 330 of the support terminal 300. A screen similar to the shovel operator selection screen 720 of FIG. 7B may be displayed on the display apparatus 230 of the management apparatus 200.

As illustrated in FIG. 8A, the reservation target function selection screen 710 includes a list 711 indicating the reservation target function and a selection icon 712.

The list 711 enumerates the selectable reservation target functions. In this example, the list 711 includes list icon ("1. engine warm-up reservation", "2. self-diagnosis reservation", "3. operation restriction reservation", and "4. automatic task reservation", and the like) corresponding to the engine warm-up function, the function of self-diagnosis, the operation restriction function, and the automatic task function, and the like of the shovel 100. In the list 711, list icons are arranged in the vertical direction. The shovel user such as the operator of the shovel 100 and the manager in the work site can select and confirm any one of the types of reservation target functions in the list 711 by moving the selection icon 712 in the vertical direction on reservation target function selection screen 710 with the input apparatus 52.

When the any one of the types of reservation target functions is confirmed from the list 711, a reservation reception screen (hereinafter referred to as an "execution condition setting screen") for setting an execution condition corresponding to the type of the reservation target function selected from the reservation target function selection screen 710 is displayed as the display content of the display apparatus 50. Then, the shovel user such as the operator of the shovel 100 and the manager in the work site can complete (confirm) the reservation related to the execution of the reservation target function selected by the reservation target function selection screen 710 by confirming the setting of the execution condition with the input apparatus 52.

Also, as illustrated in FIG. 8B, the shovel operator selection screen 720 includes a list 721 of multiple selectable shovels 100 and a list 722 of selectable operators.

The support terminal user can cause the display content of the display apparatus 330 to transition to the reservation target function selection screen (see FIG. 8A) related to a selected shovel 100 by selecting any one of the multiple shovels 100 enumerated in the list 721 and performing an operation for confirming it with the input apparatus 340 (for example, a touch panel implemented in the display apparatus 330). Then, the support terminal user can use the reservation function of the selected shovel 100 in a specific manner by selecting the reservation target function and setting the execution condition on the reservation target function selection screen and the execution condition setting screen subsequent thereto.

Also, by selecting any one of multiple operators enumerated in the list 722 and performing an operation to confirm the selected operator with the input apparatus 340, the support terminal user can cause the display content of the display apparatus 330 to transition to the reservation target function selection screen (see FIG. 8A) related to the shovel 100 which the selected operator is scheduled to board soon. Then, the support terminal user can use the reservation function of the shovel 100 corresponding to the selected operator in a specific manner by selecting the reservation target function and setting the execution condition on the reservation target function selection screen and the execution condition setting screen subsequent thereto. Therefore, the support terminal user can select the reservation target function of performing reservation based on the reservation function from among multiple reservation target functions in accordance with the attributes and the like of the operator who is going to board the shovel 100, and can set the execution condition related to the execution of the reservation target function.

Effects

Next, the effects of the task support system SYS according to the present embodiment (the shovel 100, the management apparatus 200, and the support terminal 300) are explained.

In the present embodiment, the shovel 100 receives the reservation related to the execution of the predetermined function of the shovel 100, in accordance with a predetermined input received from the shovel user or a reservation instruction signal received from an external apparatus (specifically, from the support terminal 300 via the management apparatus 200 or the management apparatus 200). Then, the shovel 100 executes the predetermined function in accordance with the execution condition designated by the received reservation (the reservation information 304A).

Accordingly, the operator of the shovel 100, the manager in the work site, and the like can cause the shovel 100 to automatically execute the predetermined function in accordance with the execution condition designated by the reservation, without going to the shovel 100 or without sending someone to the shovel 100. Also, the operator of the shovel 100, the manager in the work site, and the like can reduce the deadtime and the like of the shovel 100 by appropriately setting the execution condition of the predetermined function, and the work efficiency of the shovel 100 can be improved. Therefore, the shovel 100 can support efficient operation of the shovel 100.

Furthermore, in the present embodiment, the predetermined function of the reservation target may include a function (an engine warm-up function) for automatically starting and preparing the start of the work, i.e., performing the engine warm-up. In this case, the shovel 100 may automatically start and prepare the start of the work (the engine warm-up) in accordance with execution conditions including at least one of: the temporal condition including at least one of date and time, a day of week, and a duration, designated by the received reservation (the reservation information 304A); and the environment condition.

Accordingly, the operator of the shovel 100, the manager in the work site, and the like can cause the shovel 100 to automatically start in accordance with the temporal condition and to perform preparation of the work such as an engine warm-up and the like, without going to the shovel 100 and without sending someone to the shovel 100. Therefore, the shovel 100 can support more efficient operation of the shovel 100 in a specific manner.

It should be noted that the preparation of the start of the work may be other than the engine warm-up. For example, in a case where the task support system SYS includes a mobile crane instead of or in addition to the shovel 100, the preparation of the start of the work may be a task for automatically erecting the crane boom of the mobile crane from the horizontally retracted state.

Furthermore, in the present embodiment, the predetermined function of the reservation target may include a function of self-diagnosis. In this case, the shovel 100 may perform the self-diagnosis in accordance with execution conditions including at least one of: the temporal condition including at least one of date and time, a day of week, and a duration, designated by the received reservation (the reservation information 304A); and the operation situation condition.

Accordingly, the operator of the shovel 100, the manager in the work site, and the like can cause the shovel 100 to automatically perform the self-diagnosis in accordance with the temporal condition and the operation situation condition without going to the shovel 100 and without sending someone to the shovel 100. Therefore, the shovel 100 can support more efficient operation of the shovel 100 in a specific manner.

Furthermore, in the present embodiment, the predetermined function of the reservation target may include a function (an automatic task function) for automatically performing a predetermined task. In this case, the shovel 100 may automatically perform the predetermined task in accordance with execution conditions including at least one of: the temporal condition including at least one of date and time, a day of week, and a duration, designated by the received reservation (the reservation information 304A); and the operation situation condition.

Accordingly, the operator of the shovel 100, the manager in the work site, and the like can cause the shovel 100 to automatically perform the predetermined task in accordance with the temporal condition and the like without going to the shovel 100 and without sending someone to the shovel 100. Therefore, the shovel 100 can support more efficient operation of the shovel 100 in a specific manner.

Furthermore, in the present embodiment, the predetermined task automatically performed by the shovel 100 may include multiple tasks (for example, an excavation task, a backfill task, a finishing task, and the like). In this case, the shovel 100 automatically performs multiple tasks in order in accordance with execution conditions including at least one of: the temporal condition including at least one of date and time, a day of week, and a duration for each of the multiple tasks, designated by the received reservation (the reservation information 304A); the operation situation condition; and the environment condition.

Accordingly, the operator of the shovel 100, the manager in the work site, and the like can cause the shovel 100 to successively perform, for example, a series of multiple tasks that should be completed in a day in accordance with the temporal condition and the like, without going to the shovel 100 and without sending someone to the shovel 100. Therefore, the shovel 100 can support more efficient operation of the shovel 100.

Furthermore, in the present embodiment, the predetermined function of the reservation target may include the operation restriction function of restricting the movement of the shovel 100. In this case, the shovel 100 may restrict the movement of the shovel 100 in accordance with execution conditions including at least one of: the temporal condition including at least one of date and time, a day of week, and a duration, designated by the received reservation (the reservation information 304A); the operation situation condition; and the environment condition Accordingly, the manager and the like in the work site can restrict the movement of the shovel 100 in accordance with the temporal condition and the like, without going to the shovel 100 and without sending someone to the shovel 100. Therefore, for example, the operation restriction of the shovel 100 is applied as necessary in accordance with the requirement in operation of the shovel 100, so that the shovel 100 can support more efficient operation of the shovel 100 in a specific manner.

Furthermore, in the present embodiment, the operation restriction function may include a function (the operation time restriction function) for restricting the time period in which the shovel 100 is permitted to operate. In this case, the shovel 100 may prevent the shovel 100 from starting in accordance with execution conditions including at least one of: the temporal condition including at least one of date and time, a day of week, and a duration, designated by the received reservation (the reservation information 304A); the operation situation condition; and the environment condition, and may automatically stop (forcibly stop) the shovel 100 in accordance with execution conditions including at least one of: the temporal condition including at least one of date and time, a day of week, and a duration, designated by the reservation.

Accordingly, the manager and the like in the work site can more efficiently and strictly manage the operation time of the shovel 100. Therefore, the shovel 100 can support more efficient operation of the shovel 100 in a specific manner.

Furthermore, in the present embodiment, the shovel 100 may automatically stop (i.e., be forcibly stopped) after automatically moving to a predetermined location in relation to execution of the operation time restriction function.

Accordingly, for example, the shovel 100 can inhibit the shovel 100 from forcibly stopped on an inclined surface and the like. Therefore, the shovel 100 can secure the safety of the shovel 100 while supporting strict management of the operation time of the shovel 100.

Furthermore, in the present embodiment, the operation restriction function may include a function (an output restriction function) for restricting an output of the shovel 100 so that the output of the shovel becomes relatively low. In this case, the shovel 100 may restrict the movement of the shovel 100 so that the output of the shovel 100 becomes relatively low in accordance with execution conditions including at least one of: the temporal condition including at least one of date and time, a day of week, and a duration, designated by the reservation (reservation information 304A); the operation situation condition; and the environment condition.

Accordingly, the execution condition is appropriately set, so that the task of the shovel is inhibited from being performed with an excessive output to generate relatively large noises, and a reduction of the fuel consumption of the shovel 100 can be inhibited.

Furthermore, in the present embodiment, a plurality of driving modes of which outputs are different from one another may be provided in the shovel 100. In this case, the shovel 100 may cause only some of driving modes with a relatively low output, from among the plurality of driving modes, to be available in accordance with execution conditions including at least one of: the temporal condition including at least one of date and time, a day of week, and a duration, designated by the reservation (reservation information 304A); the operation situation condition; and the environment condition.

Accordingly, the shovel 100 can specifically restrict the movement of the shovel 100 so that the output of the shovel 100 becomes relatively lower.

Furthermore, in the present embodiment, the operation restriction function may include a function to restrict the operation related to the cooling operation of the air conditioning apparatus of the cab 10 (air conditioning restriction function). Furthermore, in accordance with an execution condition including at least one of the date-and-time condition designated by the received reservation and the environment condition, the shovel 100 may restrict the time period in which the cooling operation of the air conditioning apparatus is permitted and may restrict the operation of the air conditioning apparatus so that the temperature setting of the cooling operation becomes relatively higher.

Accordingly, the shovel 100 strictly manages the use situation of the cooling operation by the air conditioning apparatus of the shovel 100, and can inhibit the reduction of the fuel consumption (the energy efficiency) of the shovel 100 due to the use of an unnecessary cooling operation, the use of the cooling operation with an unnecessarily low temperature setting, or the like.

Furthermore, in the present embodiment, each of the management apparatus 200 and the support terminal 300 receives reservation of an execution of the predetermined function of the shovel 100 in accordance with a predetermined input received from the management apparatus user and the support terminal user. In this case, the management apparatus 200 and the support terminal 300 can cause the shovel 100 to execute the predetermined function in accordance with the condition designated by the received reservation by transmitting a signal (a reservation instruction signal) for requesting reservation to the shovel 100 (transmitting the signal via the management apparatus 200 in a case of the support terminal 300).

Accordingly, the management apparatus 200 and the support terminal 300 can make the reservation related to the execution of the predetermined function from the outside of the shovel 100. Therefore, the management apparatus user and the support terminal user such as the manager and the like of the management apparatus 200 can cause the shovel 100 to automatically execute the predetermined function in accordance with the execution condition designated by the reservation, without going to the shovel 100 and without sending someone to the shovel 100. Also, the management apparatus user and the support terminal user such as the manager and the like of the management apparatus 200 can reduce the deadtime and the like of the shovel 100 by appropriately setting the execution condition of the predetermined function, and the work efficiency of the shovel 100 can be improved. Therefore, the management apparatus 200 and the support terminal 300 can support more efficient operation of the shovel 100.

Furthermore, in the present embodiment, the management apparatus 200 and the support terminal 300 may receive reservation for each of the multiple shovels 100 or each of the multiple operators corresponding to the multiple shovels 100, and may transmit a signal for requesting the received reservation to the shovel 100.

Accordingly, for the multiple shovels 100 and the operators of the multiple shovels 100, the management apparatus 200 and the support terminal 300 can make the reservation related to the execution of the predetermined function from the outside of the shovel 100. Therefore, the management apparatus 200 and the support terminal 300 can support more efficient operation of the shovel 100.

According to the above embodiment, a technique capable of supporting more efficient operation of the work machine can be provided.

Modifications and Changes

Although the embodiment has been hereinabove described in detail above, the present disclosure is not limited to such a specific embodiment, and various modifications and changes can be made without departing from the subject matter of the present disclosure described in the claims.

For example, in the above-described embodiment, the shovel user operates the reservation screen displayed on the display apparatus 50 with the input apparatus 52, whereby the reservation related to execution of the reservation target function is received, but the reservation may be received according to other methods. For example, the controller 30 may provide an audio assistant to the shovel user through an audio output apparatus such as a speaker. In addition, the controller 30 may be configured to be able to receive reservation related to execution of a reservation target function of the shovel 100 from the shovel user through an interactive interface using the input apparatus 52 (i.e., the audio input apparatus). Also, according to a similar method, the management apparatus 200 and the support terminal 300 may receive the reservation of the reservation target function of the shovel 100 from the management apparatus user and the support terminal user.

Although, in the above embodiment and modified examples, the shovel 100 is configured to hydraulically drive all of various operation elements such as the lower traveling body 1, the upper turning body 3, the boom 4, the arm 5, the bucket 6, and the like, some of them may be configured to be electrically driven. In other words, the configuration and the like disclosed in the above embodiment may be applied to a hybrid shovel, an electric shovel, and the like.

DESCRIPTION OF THE REFERENCE NUMERALS

30 controller
30E computation device
31 proportional valve
32 shuttle valve
40 ambient information obtaining apparatus
42 shovel information obtaining apparatus
50 display apparatus
52 input apparatus
60 communication apparatus
100 shovel (work machine)
200 management apparatus (information processing apparatus)
210 control apparatus
211 reservation screen display processing unit
212 reservation reception unit
300 support terminal (information processing apparatus)
301 reservation target functional unit
302 reservation screen display processing unit
303 reservation reception unit
304 reservation information storage unit
305 reservation execution unit
310 control apparatus
311 reservation screen display processing unit
312 reservation reception unit

The invention claimed is:

1. A work machine comprising:
a traveling body;
a work attachment; and
a processing circuitry configured to
receive a reservation of an automatic execution of a predetermined function among a plurality of functions in accordance with an input received by the work machine or in accordance with a signal received from an external apparatus, the plurality of functions including an automatic task function, a function of self-diagnosis, and an operation restriction function, the function of self-diagnosis being a function of diagnosing whether there is an abnormality or a malfunction in an apparatus in the work machine, and
automatically execute the predetermined function of the reservation based on an execution condition designated by the reservation,
wherein the automatic task function includes at least automatically performing a task using the work attachment and automatically stopping the work machine,
the function of self-diagnosis includes at least changing a time required for self-diagnosis based on a day of week, and
the operation restriction function includes at least one of restricting a time period in which the work machine is permitted to operate, setting a restriction that, among a plurality of driving modes whose outputs are different from each other, a driving mode whose output is lower than an output of another driving mode is made available. and preventing cooling temperature of an air conditioning apparatus from being set to lower than a predetermined temperature.

2. The work machine according to claim 1, wherein the plurality of functions further include a function of automatically starting the work machine and preparing a start of work, and the predetermined function is the function of automatically starting the work machine and preparing the start of work, and
the processing circuitry is configured to automatically start the work machine and prepare the start of the work in accordance with the execution condition including at least one of: a time-related condition including at least one of a date and time, the day of week, or a duration designated by the reservation; or a condition related to an environment around the work machine.

3. The work machine according to claim 2, wherein the preparing of the start of the work includes an engine warm-up.

4. The work machine according to claim 2, wherein the preparing of the start of the work includes a task of automatically erecting a crane boom of the work machine.

5. The work machine according to claim 1, wherein the predetermined function is the function of self-diagnosis, and the processing circuitry is configured to automatically execute the function of self-diagnosis in accordance with the execution condition including the day of week and at least one of: a time-related condition including at least one of a date and time, a day of week, or a duration designated by the reservation; or a condition related to an operation situation of the work machine.

6. The work machine according to claim 1, wherein the predetermined function is the automatic task function, and the processing circuitry is configured to execute the automatic task function in accordance with the execution condition including at least one of: a time-related condition including at least one of a date and time, the day of week, or a duration designated by the reservation; a condition related to an operation situation of the work machine; or a condition related to an environment around the work machine.

7. The work machine according to claim 6, wherein the task includes a plurality of tasks, and the processing circuitry is configured to cause the work machine to automatically perform the plurality of tasks in order in accordance with the execution condition designated by the reservation with respect to each of the plurality of tasks.

8. The work machine according to claim 1, wherein the predetermined function is the operation restriction function, and the processing circuitry is configured to execute the operation restriction function in accordance with the execution condition including at least one of: a time-related condition including at least one of a date and time, the day of week, or a duration designated by the reservation; a condition related to an operation situation of the work machine; or a condition related to an environment around the work machine.

9. The work machine according to claim 8, wherein the operation restriction function includes of restricting the time period in which the work machine is permitted to operate, and the processing circuitry is configured to prevent the work machine from starting in accordance with the execution condition including the time-related condition including the at least one of the date and time, the day of week, or the duration designated by the reservation, and automatically stop the work machine in accordance with the execution condition including the time-related condition including the at least one of the date and time, the day of week, or the duration designated by the reservation.

10. The work machine according to claim 9, wherein the processing circuitry is configured to automatically stop the work machine after causing the work machine to automatically move to a predetermined location, in accordance with the execution condition including the time-related condition including the at least one of the date and time, the day of week, or the duration designated by the reservation.

11. The work machine according to claim 8, wherein the operation restriction function includes setting the restriction, and the processing circuitry is configured to set the restriction in accordance with the execution condition including the at least one of the time-related condition including the at least one of the date and time, the day of week, or the duration designated by the reservation; the condition related to the operation situation of the work machine; or the condition related to the environment around the work machine.

12. The work machine according to claim 8, wherein the operation restriction function further includes restricting a time period in which a cooling operation of the air conditioning apparatus is permitted, and the processing circuitry is configured to restrict the time period in accordance with the execution condition including the at least one of: the time-related condition including the at least one of the date and time, the day of week, or the duration designated by the reservation; or the condition related to the environment around the work machine.

13. An information processing apparatus comprising:

a processing circuitry configured to receive a reservation of an automatic execution of a predetermined function among a plurality of functions of a work machine including a traveling body and a work attachment, in accordance with an input received by the information processing apparatus or in accordance with a signal received from an external apparatus, the plurality of functions including an automatic task function, a function of self-diagnosis, and an operation restriction function, the function of self-diagnosis being a function of diagnosing whether there is an abnormality or a malfunction in an apparatus in the work machine, wherein the processing circuitry is configured to cause the work machine to automatically execute the predetermined function of the reservation based on a condition designated by the reservation, by transmitting a signal requesting the reservation to the work machine, the automatic task function includes at least automatically performing a task using the work attachment and automatically stopping the work machine.

the function of self-diagnosis includes at least changing a time required for self-diagnosis based on a day of week, and the operation restriction function includes at least one of restricting a time period in which the work machine is permitted to operate, setting a restriction that, among a plurality of driving modes whose outputs are different from each other, a driving mode whose output is lower than an output of another driving mode is made available, and preventing cooling temperature of an air conditioning apparatus from being set to lower than a predetermined temperature.

14. A non-transitory computer-readable recording medium storing a program that causes a processing circuitry of an information processing apparatus to execute a process, the process comprising:

receiving a reservation of an automatic execution of a predetermined function among a plurality of functions of a work machine including a traveling body and a work attachment, in accordance with an input received by the information processing apparatus or in accordance with a signal received from an external apparatus, the plurality of functions including an automatic task function, a function of self-diagnosis, and an operation restriction function, the function of self-diagnosis being a function of diagnosing whether there is an abnormality or a malfunction in an apparatus in the work machine; and causing the work machine to automatically execute the predetermined function of the reservation based on a condition designated by the reservation, by transmitting a signal requesting the reservation to the work machine, wherein the automatic task function includes at least automatically performing a task using the work attachment and automatically stopping the work machine, the function of self-diagnosis includes at least changing a time required for self-diagnosis based on a day of week, and the operation restriction function includes at least one of restricting a time period in which the work machine is permitted to operate, setting a restriction that, among a plurality of driving modes whose outputs are different from each other, a driving mode whose output is lower than an output of another driving mode is made available. and preventing cooling temperature of an air conditioning apparatus from being set to lower than a predetermined temperature.

* * * * *